US010751862B1

(12) United States Patent
Edmisten et al.

(10) Patent No.: US 10,751,862 B1
(45) **Date of Patent: *Aug. 25, 2020**

(54) T HANDLE TORQUE WRENCH WITH SLIP FUNCTION

(71) Applicants: Dallas G. Edmisten, Fellsmere, FL (US); Robert C. Edmisten, Vero Beach, FL (US)

(72) Inventors: Dallas G. Edmisten, Fellsmere, FL (US); Robert C. Edmisten, Vero Beach, FL (US)

( * ) Notice: Subject to any disclaimer, the term of this patent is extended or adjusted under 35 U.S.C. 154(b) by 297 days.

This patent is subject to a terminal disclaimer.

(21) Appl. No.: 15/675,408

(22) Filed: Aug. 11, 2017

Related U.S. Application Data

(63) Continuation-in-part of application No. 14/286,179, filed on May 23, 2014, now Pat. No. 9,731,407.

(51) Int. Cl.

| | |
|---|---|
| ***B25B 23/142*** | (2006.01) |
| ***B25B 23/14*** | (2006.01) |
| ***B25B 23/16*** | (2006.01) |
| ***B25B 23/00*** | (2006.01) |
| *B25B 15/00* | (2006.01) |
| *B25B 13/06* | (2006.01) |
| *B25B 27/00* | (2006.01) |

(52) U.S. Cl.
CPC ..... *B25B 23/1427* (2013.01); *B25B 23/0035* (2013.01); *B25B 23/141* (2013.01); *B25B 23/16* (2013.01); *B25B 13/06* (2013.01); *B25B 15/008* (2013.01); *B25B 27/0042* (2013.01)

(58) Field of Classification Search
CPC ... B25B 23/1427; B25B 23/141; B25B 23/14; B25B 23/145; B25B 23/0035
See application file for complete search history.

(56) References Cited

U.S. PATENT DOCUMENTS

| | | | | |
|---|---|---|---|---|
| 1,577,019 A | | 3/1926 | Hammer | |
| 2,503,499 A | | 4/1950 | Livermont | |
| 2,601,044 A | | 6/1952 | Mayer | |
| 2,601,799 A | * | 7/1952 | Garwood | B25B 13/466 81/480 |
| 2,732,746 A | | 1/1956 | Livermont | |

(Continued)

OTHER PUBLICATIONS

Torque Screwdriver Repair and Calibration Manual, CDI Torque Products, A Division of Snap-on Logistics Company, May 2009, 16 pages.

(Continued)

*Primary Examiner* — David B. Thomas
(74) *Attorney, Agent, or Firm* — Brian S. Steinberger; Hilary F. Steinberger; Law Offices of Brian S. Steinberg, P.A.

(57) ABSTRACT

Wrenches, apparatus, devices and methods of using a T handles with a torque wrench with adjustable torque setting controls having an automated slip function for applications such as for motorcycles, automotive, machinery and the like. The wrench allows for a user to pull up a lock feature which allows the user to selectively set a torque value by rotating the handle. Once a torque setting is made, the lock is pushed down and the wrench can be used to tighten fasteners, such as bolts, nuts, and the like. While tightening, the fastener, the wrench goes into a slip function when the setting has been reached, so that the fasteners, cannot be stripped.

2 Claims, 22 Drawing Sheets

(56) References Cited

U.S. PATENT DOCUMENTS

| | | | | |
|---|---|---|---|---|
| 2,786,377 | A | 3/1957 | Riess | |
| 2,972,271 | A | 2/1961 | Gill | |
| 3,001,430 | A | 9/1961 | Cranford | |
| 3,105,371 | A | 10/1963 | Forrest | |
| 3,651,718 | A | 3/1972 | Thomasian | |
| 3,890,859 | A | 6/1975 | Grabovac | |
| 3,906,819 | A * | 9/1975 | Curtis | B25B 23/14 81/475 |
| 3,956,905 | A | 5/1976 | Thackston | |
| 3,958,469 | A | 5/1976 | Meese | |
| 5,643,089 | A * | 7/1997 | Hummel | B25B 23/14 464/37 |
| 6,155,147 | A | 12/2000 | Dzieman | |
| 7,272,999 | B2 * | 9/2007 | Cutler | B25B 15/02 81/467 |
| 7,389,700 | B2 * | 6/2008 | Gao | B25B 23/141 73/847 |
| 7,430,945 | B2 * | 10/2008 | Gauthier | B25B 13/463 81/467 |
| 8,033,200 | B2 | 10/2011 | Johnson | |
| 8,495,935 | B2 | 7/2013 | Mountz | |
| 9,731,407 | B1 | 8/2017 | Edmisten | |

OTHER PUBLICATIONS

QDRIVER4P, http://buy1.snapon.com/catalog/parts/imgs_lg/images/QDRIVER4R.jpg, May 14, 2014, 1 page.

Seekonk T Handle Preset Slip Type Torque Wrench 1/4" Dr 2—80 in Lbs, Pro Torque Tools, http://www.protorquetools.com/prod-18-1-1022/seekonk-t-handle-preset-slip-type-torque-wrench-14-dr-2---80-in-lbs.html, May 14, 2014, 2 pages.

250 Inch-lb Steel Preset Torque Wrench for Metal Screw Caps, BASCO, Inc., http://www.bascousa.com/t-handle-preset-torque-wrench-bt4I838-100.html, May 14, 2014, 1 page.

* cited by examiner

FIG. 5A
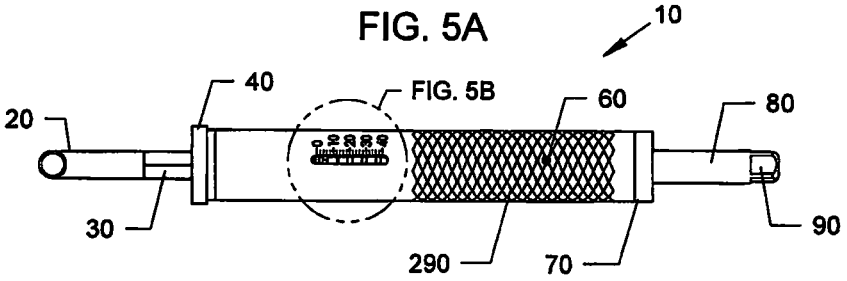
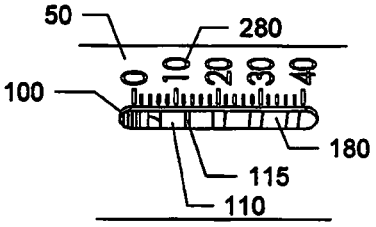
FIG. 5B
FIG. 6
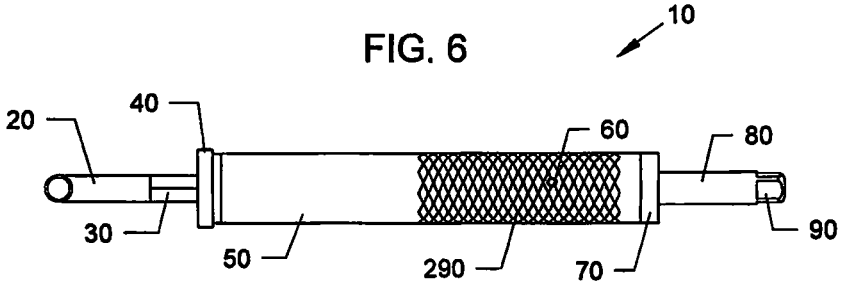

20
30
10
120
300
150
130
140
42
160
40
170
145
100
280
50
60
290
135
110
180

70
270
240
190
220
210
235
230
235
80
90

20
30
40
10
280
0
10
20
30
40
100
50
290
60
70
240
260
250

T HANDLE TORQUE WRENCH WITH SLIP FUNCTION

This application is a Continuation In Part of U.S. patent application Ser. No. 14/286,179 filed May 23, 2014, now U.S. Pat. No. 9,731,407, which is incorporated by reference in its' entirety.

FIELD OF INVENTION

This invention relates to wrenches, and in particular to wrenches, apparatus, devices and methods of adjusting torque settings on a T handle torque wrench with a slip function when a selected torque setting is reached.

BACKGROUND AND PRIOR ART

Tightening fasteners, such as bolt heads and nuts in various applications such for motorcycle repairs have often relied on socket wrenches, which do not allow the operator to supply necessary torque by just rotating the lever handle on the socket wrench. Additionally, gripping the traditional socket wrench is difficult with one hand.

Still furthermore, traditional socket wrenches generally rely on the operator having to feel when the proper torque amount has been achieved. As a result the operator can under tighten the fastener, or the operator can bear the risk of stripping the fastener if too much torque rotation is applied.

T type torque wrenches have been proposed over the years, but generally do not allow for easy adjusting to different torque settings, and generally have similar problems. For example, T torque wrenches generally require the operator have to fee the amount of pounds being applied so that the fastener can be under tightened, or the operator can bear the risk of stripping the fasteners by over rotating the T shaped handle on the torque wrench.

Both types of wrenches also do not allow for the operator to easily adjust torque settings in the wrench nor allow for the operator to visually see the selected torque settings that are desired.

Thus, the need exists for solutions to the above problems with the prior art.

SUMMARY OF THE INVENTION

A primary objective of the present invention is to provide wrenches, apparatus, devices and methods of using a T handle with a torque wrench having a slip function.

A secondary objective of the present invention is to provide T handle torque wrenches, apparatus, devices and methods having adjustable torque setting controls with a slip function for motorcycles.

A third objective of the present invention is to provide T handle torque wrenches, apparatus, devices and methods having adjustable torque setting controls with a slip function for bicycles.

A fourth objective of the present invention is to provide T handle torque wrenches, apparatus, devices and methods having adjustable torque setting controls with a slip function for automotive applications.

A fifth objective of the present invention is to provide T handle torque wrenches, apparatus, devices and methods having adjustable torque setting controls with a slip function for machinery applications.

Further objects and advantages of this invention will be apparent from the following detailed description of the presently preferred embodiments which are illustrated schematically in the accompanying drawings.

BRIEF DESCRIPTION OF THE FIGURES

FIG. 5A is a right side view of the wrench of FIG. 1.

FIG. 5B is an enlarged view of the torque adjustment graduate scale of FIG. 5A FIG. 6 is a left side view of the wrench of FIG. 1.

Second Embodiment

Figure 22:
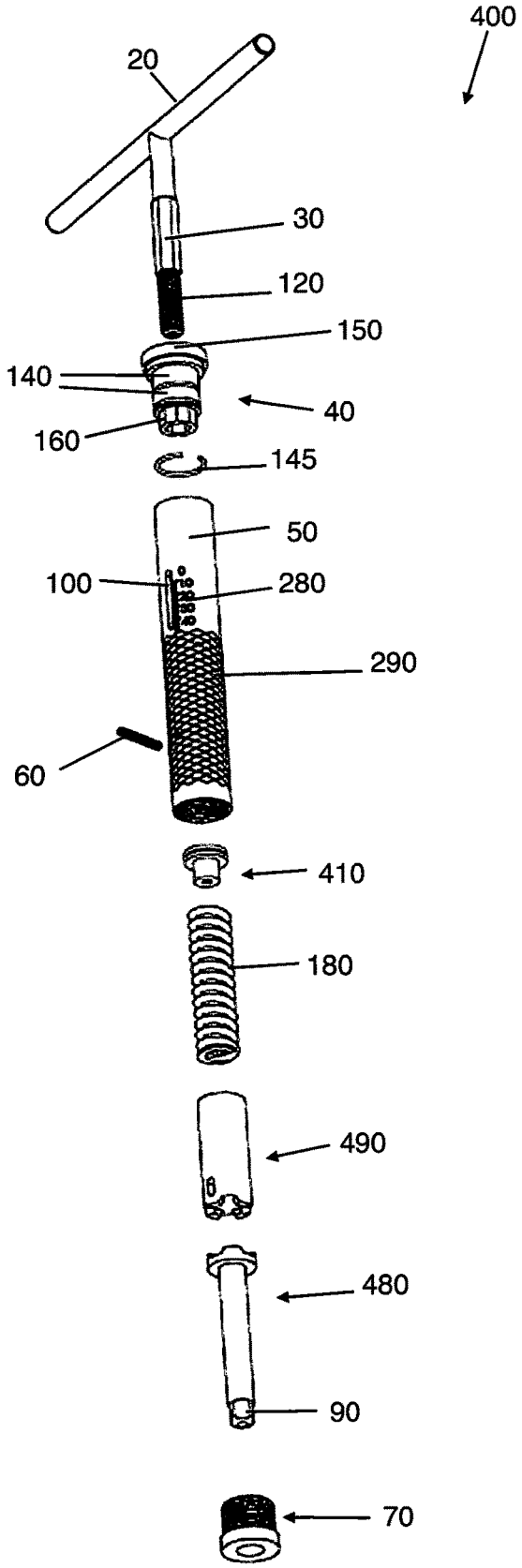

FIG. 22 is an exploded view of a second embodiment wrench.

Figure 23:
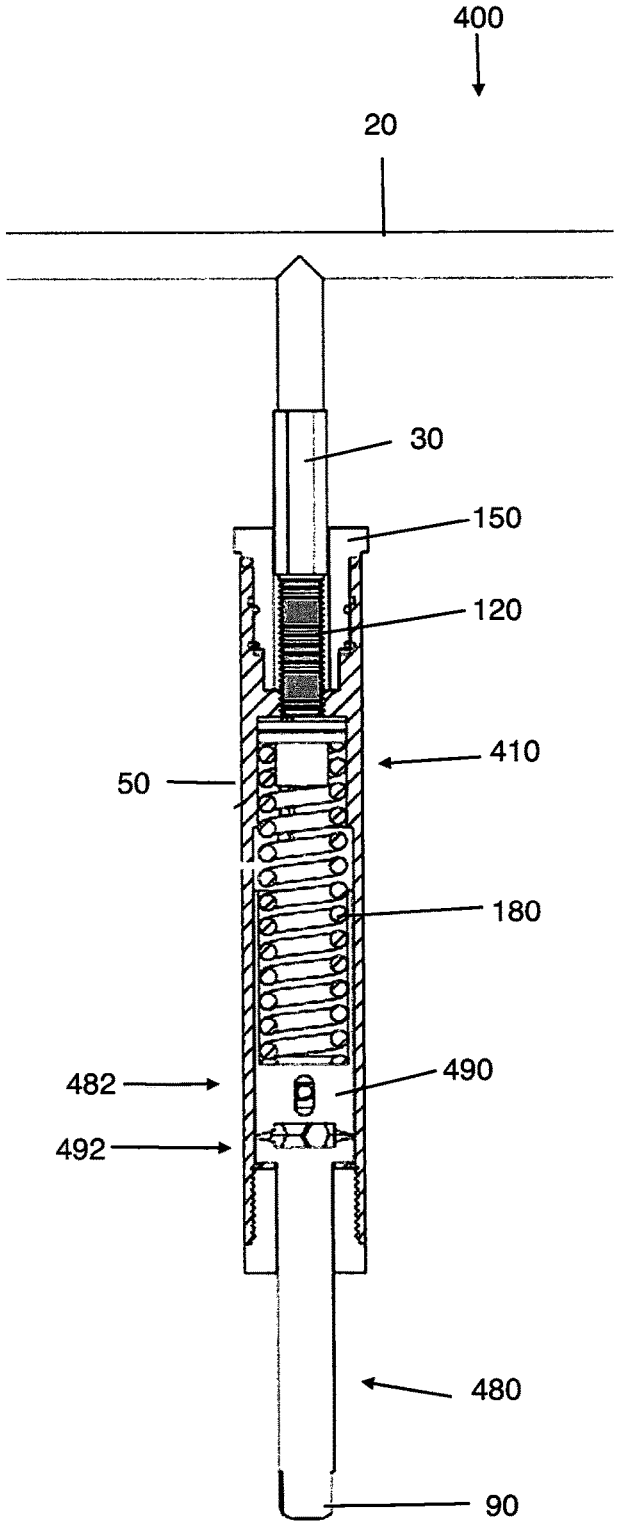

FIG. 23 is a cross-sectional view of the assembled second embodiment wrench of FIG. 21 showing detail of spacer plug used instead of the spacer of the previous embodiment, and upper and lower slip plates without ball bearings.

Figure 24:
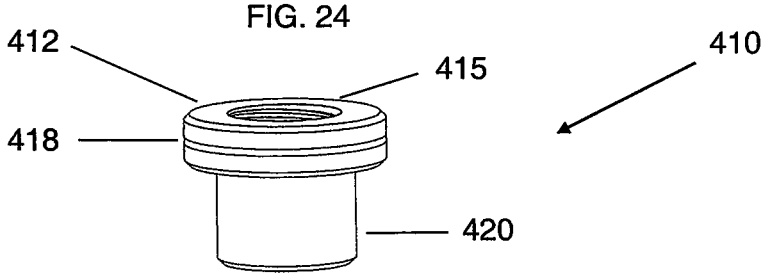

FIG. 24 is an enlarged perspective view of the spacer plug used in the wrench of FIGS. 22-23.

Figure 25:
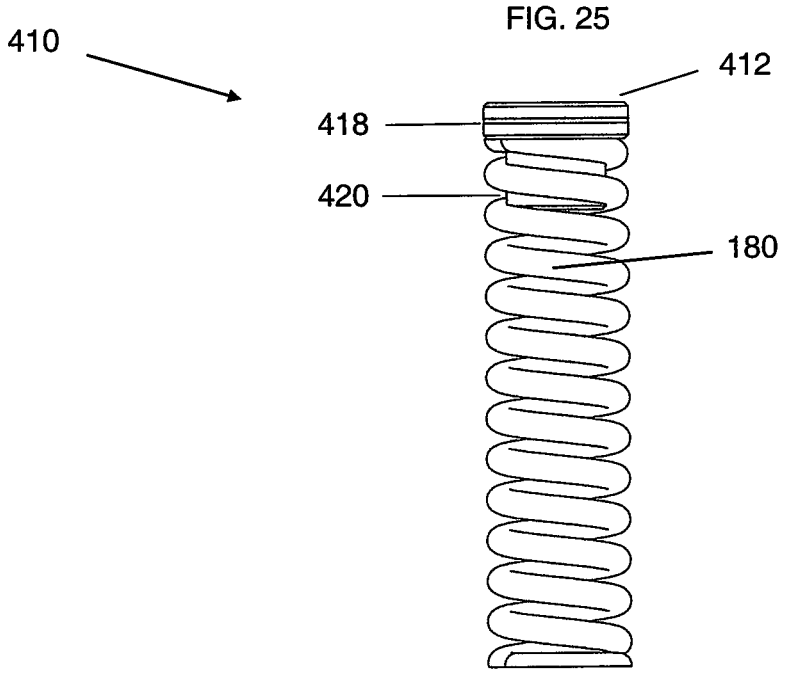

FIG. 25 is an enlarged view of the spacer plug engaging with the spring in the wrench of FIG. 23.

Figure 26:
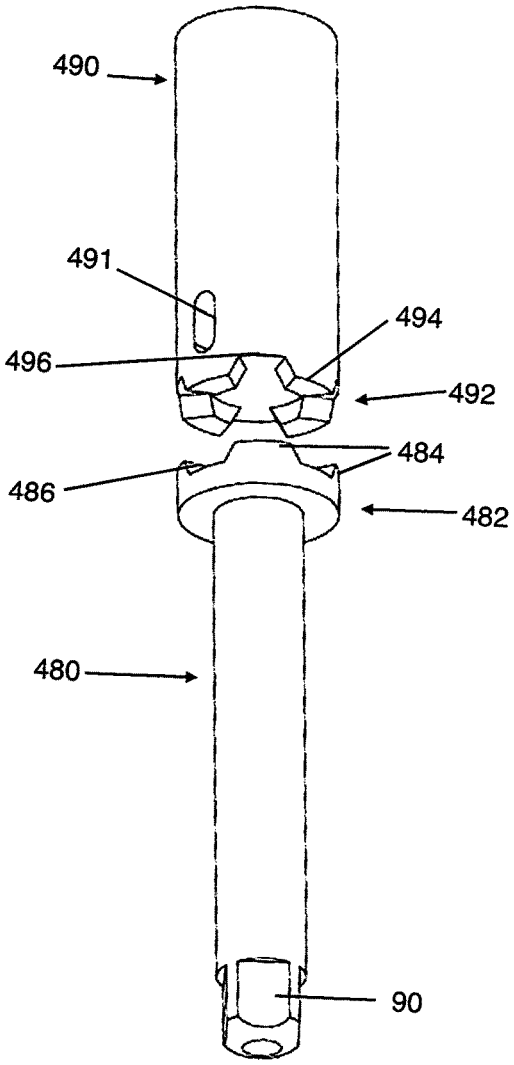

FIG. 26 is an enlarged lower front exploded view of upper slip plate on the bottom of the hollow spring cylinder support and lower slip plate on top of the torque output shaft of FIGS. 22-23.

Figure 27:
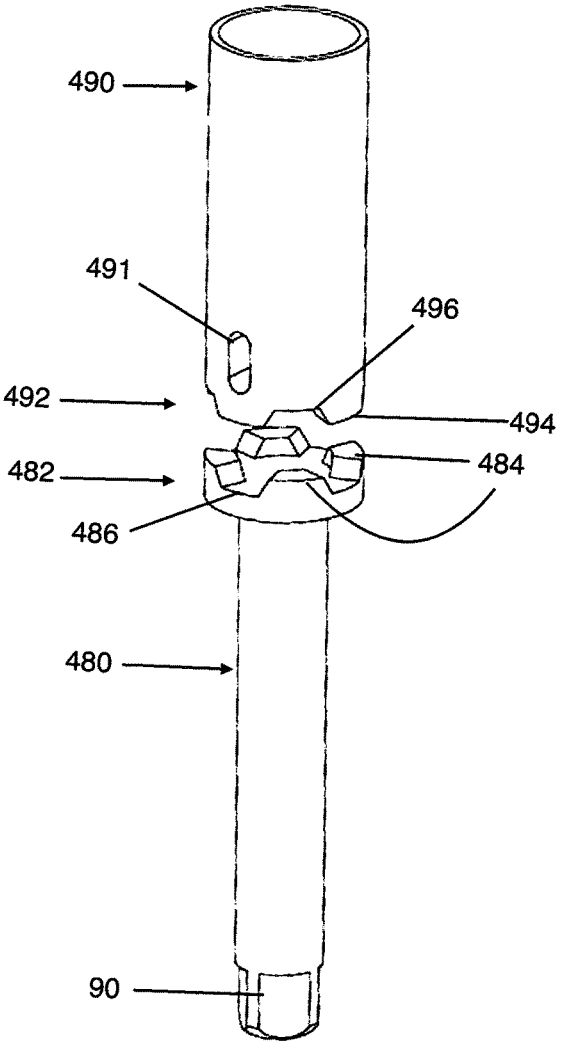

FIG. 27 is an enlarged upper front exploded view of the slip plate on the bottom of the hollow spring cylinder support and slip plate on top of the torque output shaft of FIG. 25.

Figure 28:
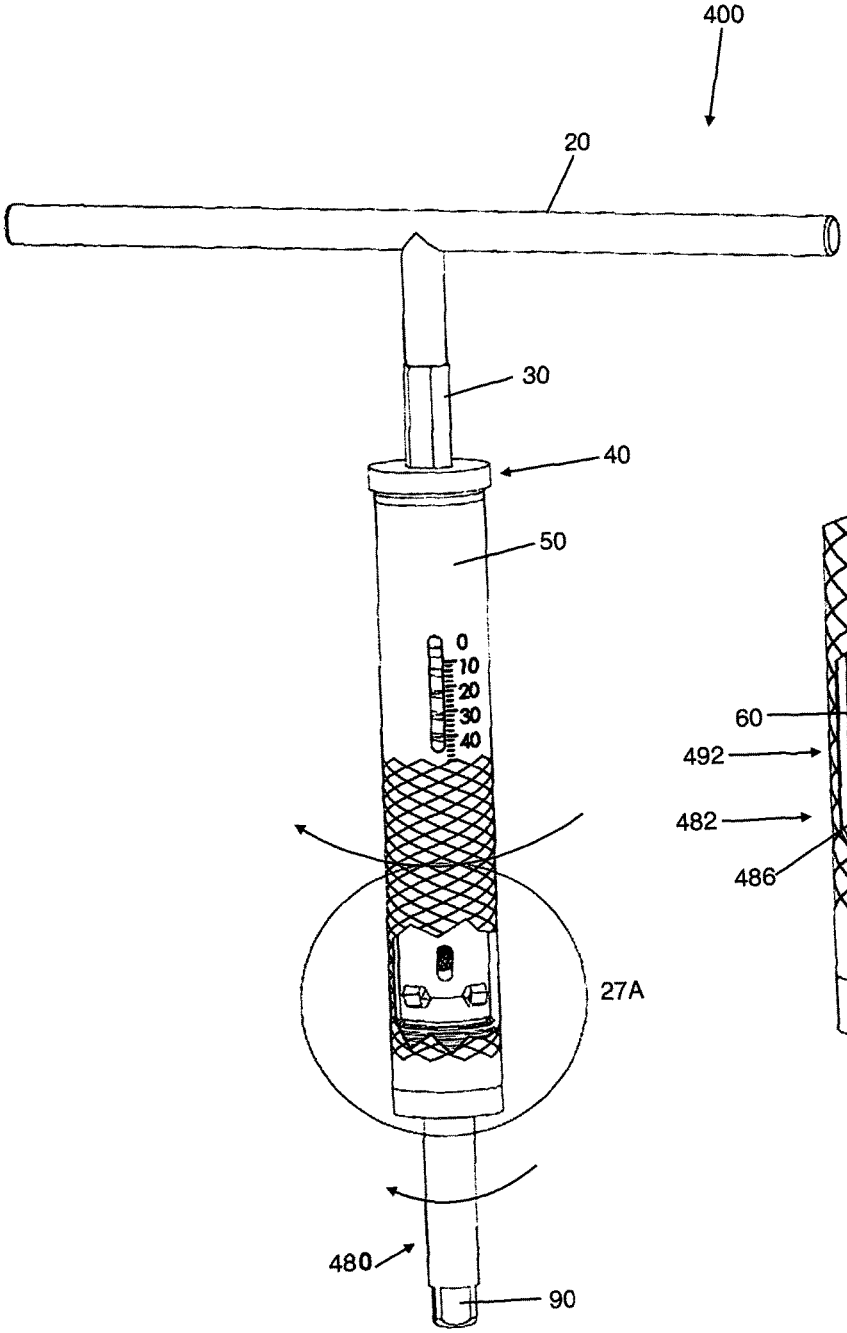

FIG. 28 is a perspective view of the wrench of FIGS. 22-23 with a partial cutaway showing the slip plates in a slip position.

Figure 28A:
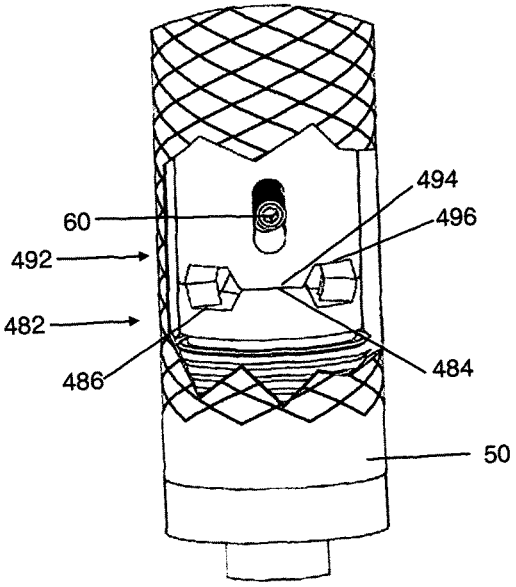

FIG. 28A is an enlarged view of the partial cutaway portion of the slip plates of FIG. 28.

Figure 29:
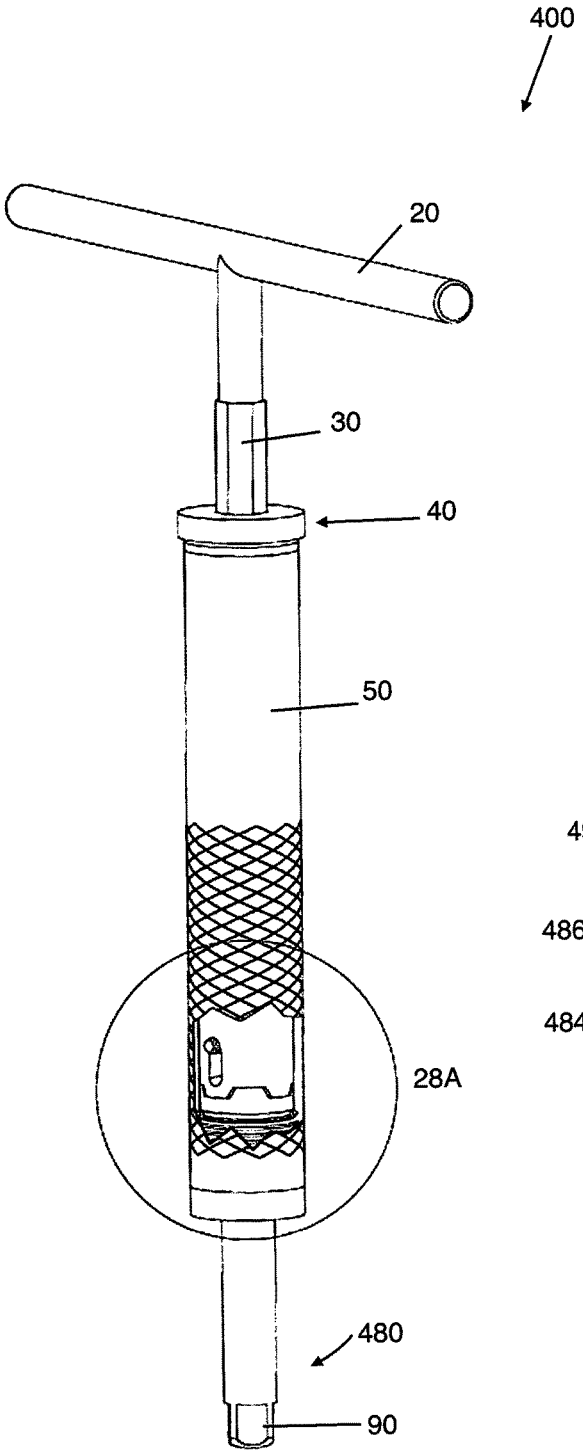

FIG. 29 is another perspective view of the wrench of FIG. 28 with a partial cutaway showing the slip plates in a lock position.

Figure 29A:
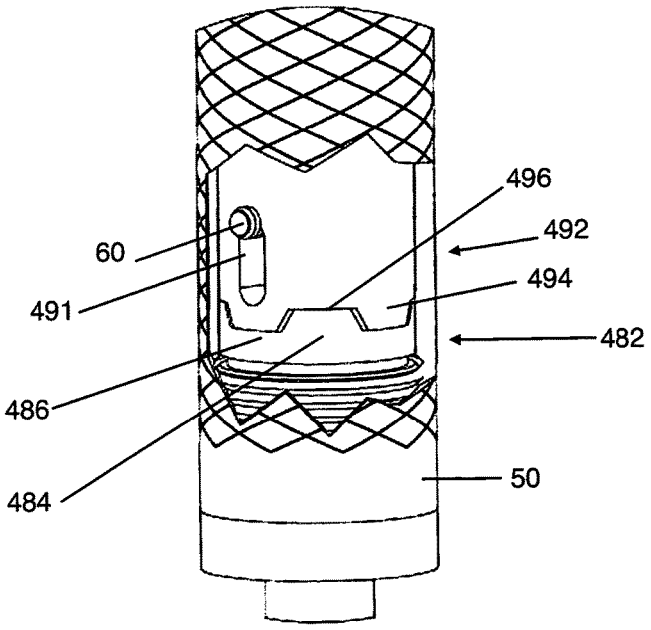

FIG. 29A is an enlarged view of the partial cutaway portion of the slip plates of FIG. 29.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

Figure 1:
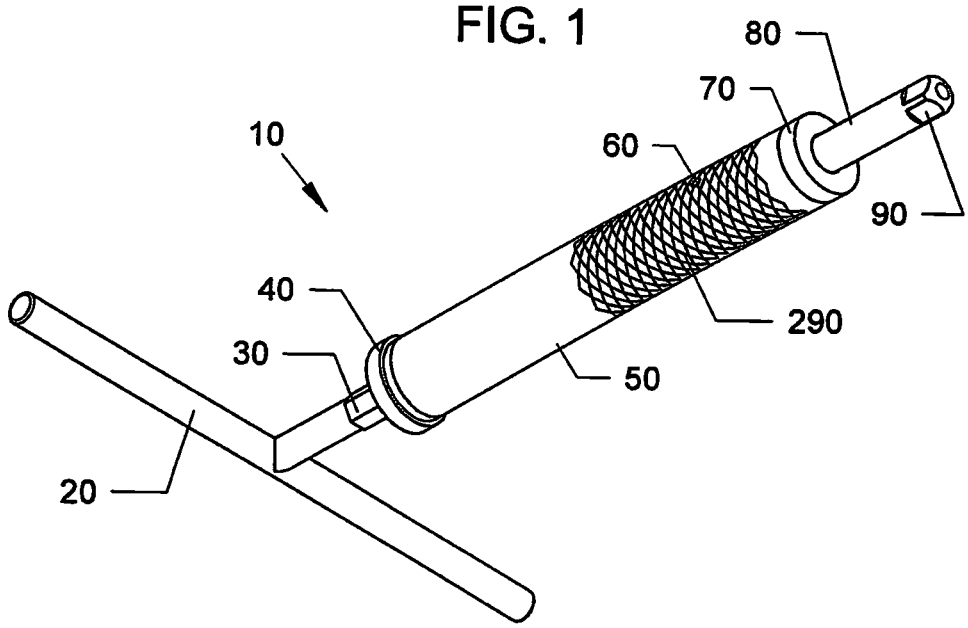
FIG. 1 is a front perspective view of the torque wrench.
Figure 2:
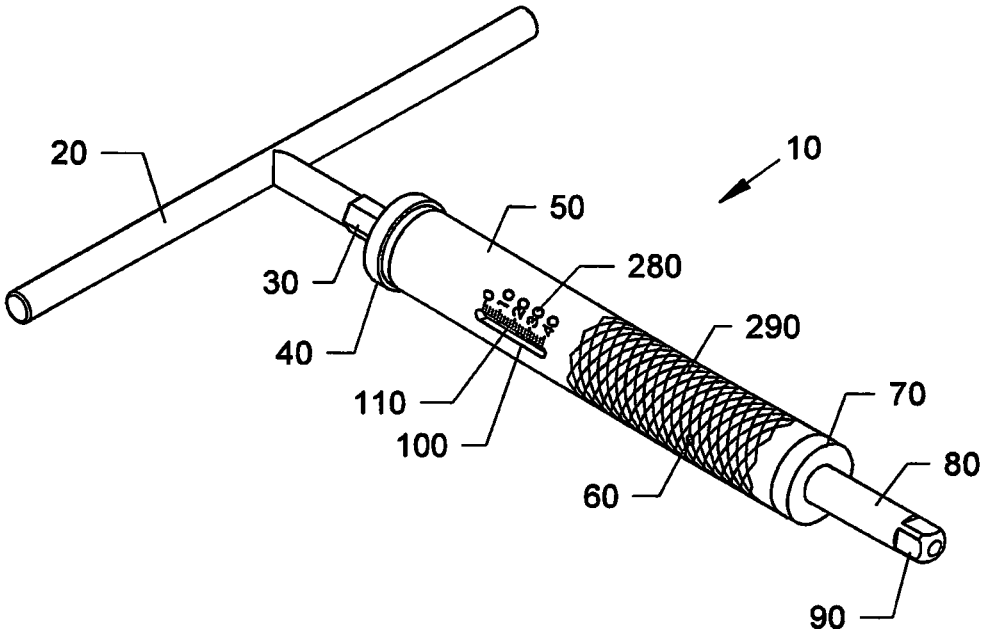
FIG. 2 is a rear perspective view of the wrench of FIG. 1.
Figure 3:
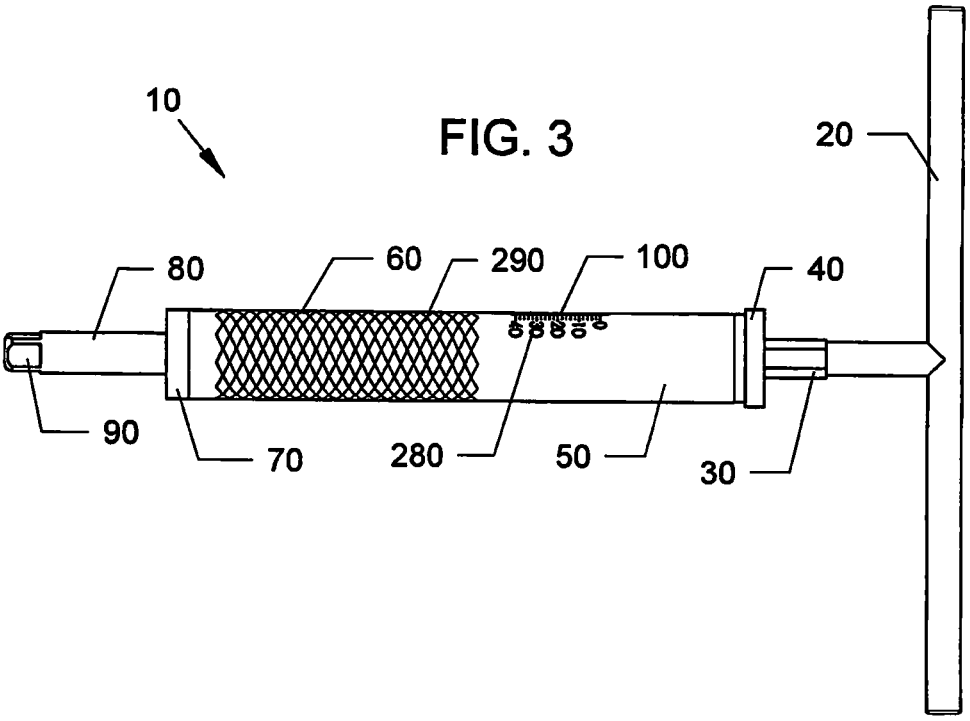
FIG. 3 is rear view of the wrench of FIG. 1.
Figure 4:
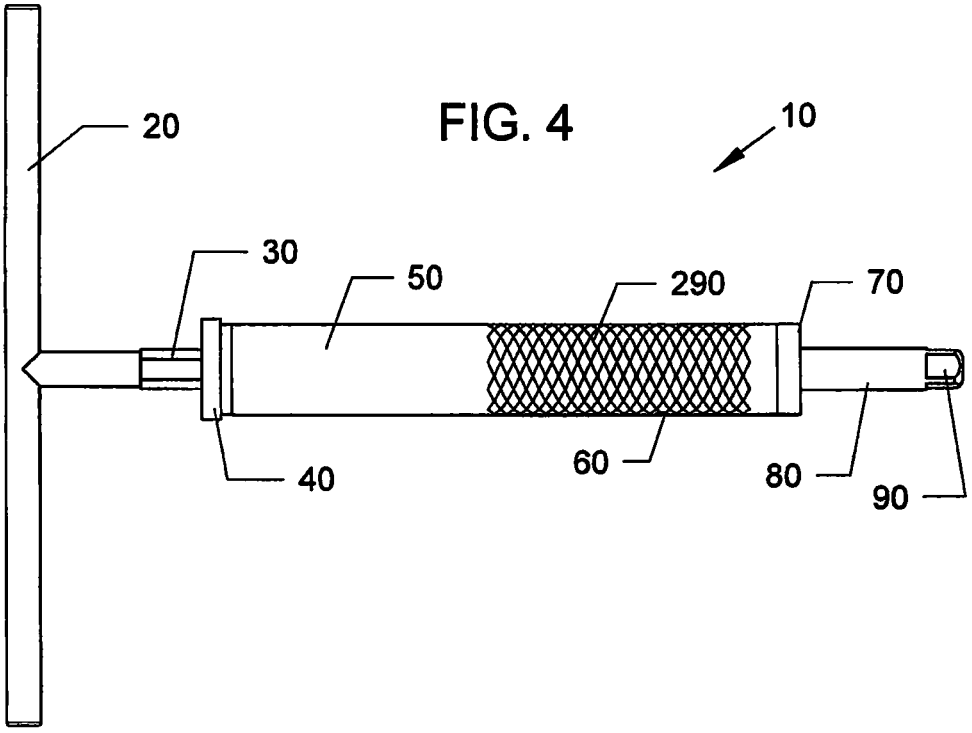
FIG. 4 is a front view of the wrench of FIG. 1.
Figure 7:
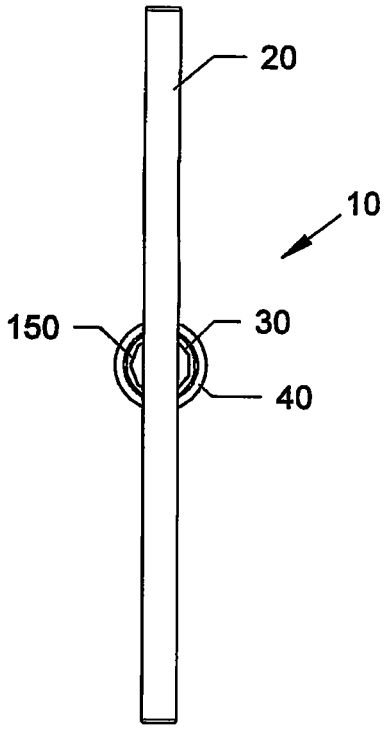
FIG. 7 is a top side view of the wrench of FIG. 1.
Figure 8:
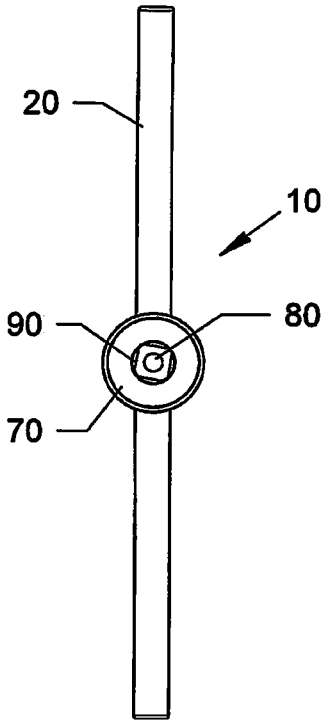
FIG. 8 is a bottom side view of the wrench of FIG. 1.

10 Torque wrench.
20 T-handle for drive and torque adjustment.
30 Hex form on t-handle.
40 Input lock for torque adjustment.
42 upper cap end with overhanging edge
50 Body of wrench.
60 Set pin.
70 Barrel end cap.
80 Torque output shaft.
90 drive, such as ⅜" square drive for drive accessories.
100 Torque set indicator slot/window.
110 Spacer plate.
115 Torque adjust indicator line on spacer plate.
120 Torque adjustment thread on t-handle.
130 Ball bearing on t-handle contacts and presses dimple on spacer plate.
135 Dimple in spacer plate.
140 Radial grooves on the input lock index to the spring clip fixed inside the wrench body to lock and unlock the adjustment feature of the assembly.
145 spring clip
150 Hex form on the inside of the input lock mates to the hex form on the outside of the t-handle.
160 Hex form on the outside of the input lock mates to the hex form on the inside of the wrench body and when the torque adjustment is locked. When the input lock is pulled up, the hex forms disengage and the torque can be adjusted.
165 Hex form inside wrench body
168 threaded neck inside body 50
170 Groove inside the wrench body holds the spring clip.
180 Clutch spring provides clutch resistance to torque.
190 Bearing holding plate holds the ball bearings and transfers the radial movement of the output shaft to linear movement which compress the torque spring.
200 Ball bearings.
210 Cavities in the bearing holding plate hold the ball bearings.
220 Slot in the bearing holding plate engages the set pin and prevents rotation of the plate.
230 Slip plate is part of the output shaft and, when the shaft attempts to rotate, provides cam-action resistance to the ball bearings being held by the bearing holding plate. As this resistance is overcome, the bearing holding plate is lifted compressing the clutch spring. It is the tension of this clutch spring (which has been adjusted by the t-handle/input lock feature) which determines the torque setting of the assembly.
235 Bearing nests on the slip plate with sloping/inclined inner sides
240 Standard drive socket
250 Oil filter drive accessory
260 Hex drive accessory
270 Square cavity in drive accessories mates to ⅜" square drive on output shaft.
280 Torque adjustment graduated scale.
290 Knurled grip.
300 T-handle retaining pin prevents the handle from spinning out of the threaded body.
400 Second embodiment Torque Wrench
410 spacer plug
412 base
415 threaded indentation in top of base
418 Marker indicator line
420 stem for insertion into top of spring
480 torque output shaft
482 slip plate on top of shaft
484 raised cam lobes (flat topped humps with outwardly sloped sides)
486 grooves between cam lobes
490 hollow spring cylinder support
491 slot for pin 60
492 slip plate on bottom of cylinder support
494 raised cam lobes (flat topped humps with outwardly sloped sides)
496 grooves between cam lobes FIG. 1 is a front perspective view of the torque wrench 10. FIG. 2 is a rear perspective view of the wrench 10 of FIG. 1. FIG. 3 is rear view of the wrench 10 of FIG. 1. FIG. 4 is a front view of the wrench 10 of FIG. 1. FIG. 5A is a right side view of the wrench 10 of FIG. 1. FIG. 5B is an enlarged view of the torque adjustment graduate scale 280 in the torque set indicator slot/window 100 of FIG. 5A FIG. 6 is a left side view of the wrench 10 of FIG. 1. FIG. 7 is a top side view of the wrench 10 of FIG. 1. FIG. 8 is a bottom side view of the wrench 10 of FIG. 1.

Referring to FIGS. 1-8, the torque wrench 10 can include a T-handle 20 for drive and torque adjustment having a stem with a hex form 30 that passes into a input lock 40 that is used for torque adjustment, which is described in more detail later. The input lock 40 is on the upper end of an elongated generally cylindrical body 50 of the wrench 10. Along a perimeter of a lower surface of the wrench 10 can be a knurled grip surface 290 to allow for a user to more easily grip the wrench 10 with a set pin 60 in one side of the body 50. Knurled surface or gripping surface 290 can be on part of or on all the body 50 surface for enhancing grip.

On the lower end of the body 50 can be a barrel end cap 70. The end cap 70 can be screwed on the bottom of body 50 or alternatively, press-fit on the bottom. Extending below the barrel end cap 70 of the body 50 can be a torque output shaft 80 with an exposed drive end 90, such as but not limited to a ⅜ inch square drive for use with drive accessories, and the like. Other sized drive ends can also be used. Drive 90 can have a head with a spring biased detent to better lock into a drive accessory such as a socket, and the like.

Referring to FIGS. 2, 3, 5A, 5B, the torque set indicator slot/window 100 can have next to it a torque adjustment graduated scale 280, with a spacer plate 110 visible in the slot/window 100. The spacer plate 110 which will be described in more detail later, can have a torque adjustment indicator line 115 visible from outside of the slot/window 100 that can line up with a graduation line on the outside scale 280 to indicate the torque setting. The torque adjustment graduated scale can be shown in various units, such as but not limited to foot pounds (Ft-Lb), newton-metres (N-M), and the like, and in any other torque measurement units. For example, the scale 280 can have readings of anywhere between 0 and 40 Foot Pounds, and the like. Other ranges and the like, can also be used.

Input lock 40 can have a vertical line on an exterior surface, and the top of body 50 can have a horizontal scale similar to scale 280. Rotating handle 20 when setting the torque setting causes lock 40 to rotate and the exterior vertical line on lock 40 is moved to a selected torque setting. For example, moving the vertical line on lock 40 to scale setting #10 will also result in moving the spacer plate 110 and line 115 visible through slot/window 100 to #10 torque setting on scale 280. The user when adjusting the torque setting can easily see the selected torque setting that is desired. Also, the horizontal scale can be on the bottom edge of lock 40 and the visible vertical line can be on top of body 50.

Figure 9A:
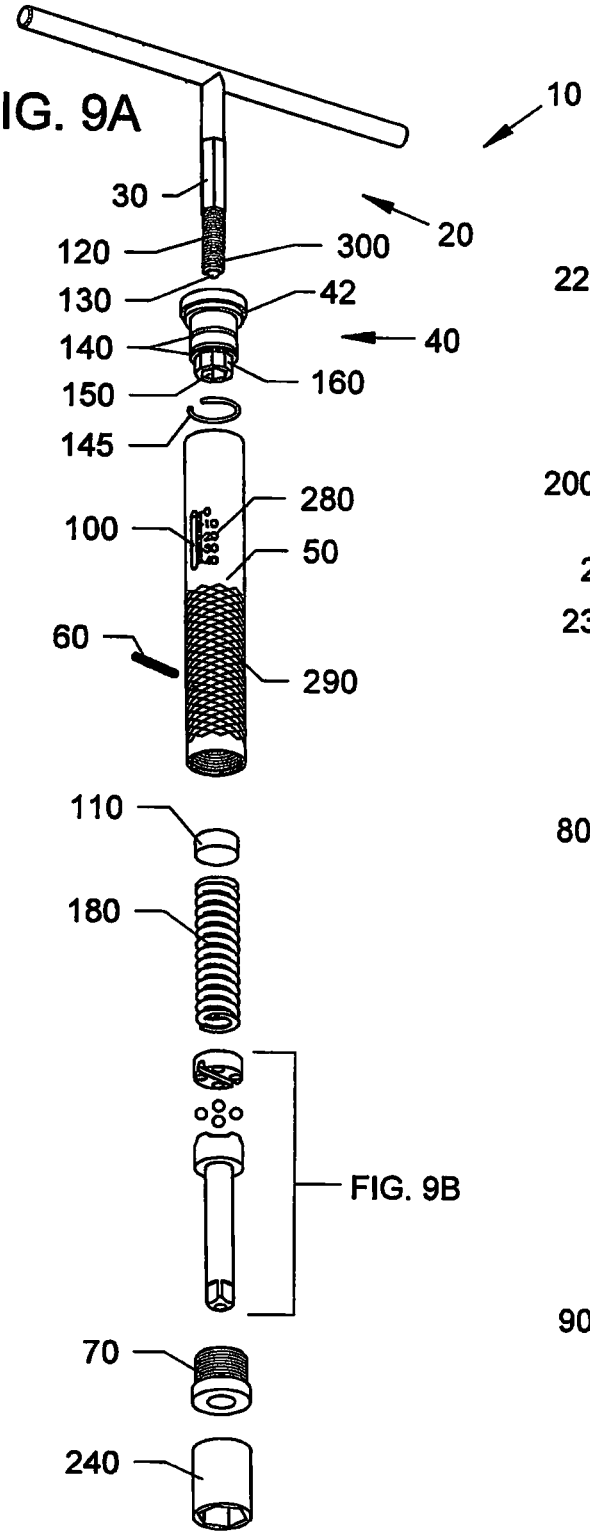
FIG. 9A is an exploded view of the wrench of FIG. 1.
Figure 9B:
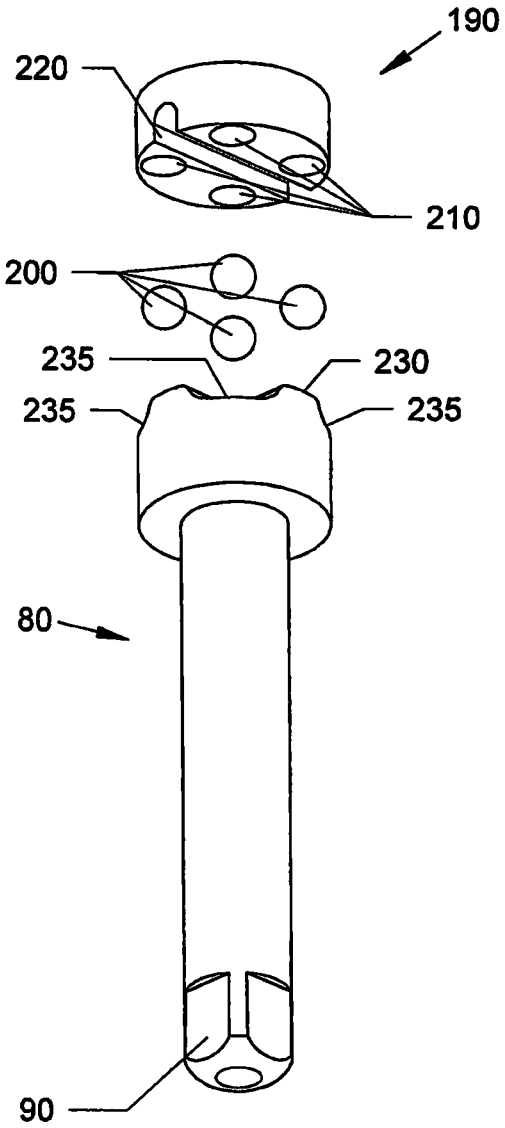
FIG. 9B is an enlarged view of the clutch detail of FIG. 9A.
Figures 10A, 10B:
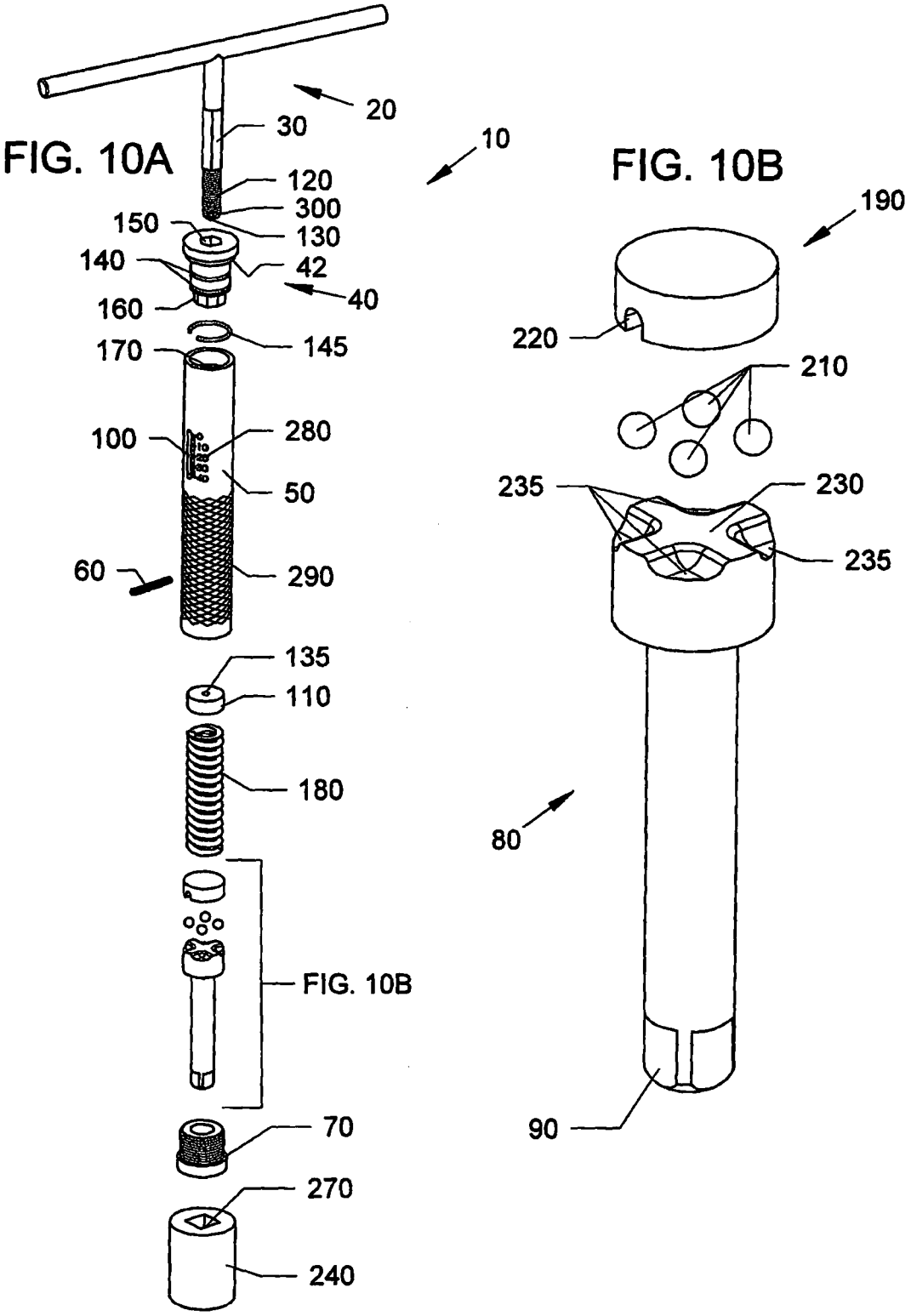
FIG. 10A is another exploded view of the wrench of FIG. 1.
FIG. 10B is an enlarged view of the clutch detail of FIG. 10A

FIG. 9A is an exploded view of the wrench 10 of FIG. 1. FIG. 9B is an enlarged view of the clutch detail 190-235 of FIG. 9A. FIG. 10A is another exploded view of the wrench 10 of FIG. 1. FIG. 10B is an enlarged view of the clutch detail 190-235 of FIG. 10A.

Referring to FIGS. 9A-10B, extending below the hex form 30 on the T-handle 20 can be a torque adjustment thread 120 with an end having a ball bearing 130 that presses into the dimple 135 on the spacer plate 110. A T-handle retaining pin 300 can extend out from the threaded 120 portion of the T-handle 20 which can prevent the T-handle 20 from spinning out of the threaded neck 168 (shown more clearly in FIGS. 12-15). Alternatively, pin 300 can be pinned together with spacer plate 110 with threads.

The input lock 40 can have an upper cap end 42 with overhanging edge 42, that can be gripped by the user to adjust the torque settings which will be described in more detail later. Input lock 40 can have radial grooves 140 which index to the spring clip 145 which is held by a groove 170 inside of wrench body 50.

The hex form 150 on the inside of the input lock 40 is used to mate to the hex form 30 on the outside of the T-handle 20. The hex form 160 on the outside of the input lock 40 is used to mate to the hex form 165 (shown in FIGS. 12-15) on the inside of the wrench body 50 when the torque adjustment is to be locked. When the input lock 40 is pulled up (shown if FIG. 13), the hex forms 160 and 165 disengage from one another, and the torque setting can be adjusted as desired by the user.

The spacer plate 110 sits between the ball bearing 130 underneath the torque adjustment threads 120, and an upper end of the clutch spring 180, the latter of which provides clutch resistance to torque. Underneath spring 180 can be a bearing holding plate 190 which holds ball bearings 200 in generally circular cavities 210 under the plate 190. A slot 220 in the bearing holding plate 190 engages the set pin 60, which can pass through a side opening in the wrench body 50. The set pin 60 can be used to prevent rotation of plate 190. Pin 60 can be partially or fully threaded or be press fit in through the side of body 50.

The selected torque setting creates the spring tension (in spring 180) controlling how high the plate 190 can rise inside of body 50. Pin 60 prevents plate 190 from going down inside of body 50. However, pin 60 does not stop plate 190 from rising inside of body 50.

Below the ball bearings 200 can be a slip plate 230 which is the upper part of the output shaft 80. Bearing nests 235 in the upper surface of slip plate 230 allow for supporting the bearings. The bearing nests can have sloping/inclined inner side surfaces, for use with a slip function which will be described in more detail later. The slip plate 230 is part of the output shaft 80 when shaft 80 attempts to be rotated, and can provide a cam action resistance to the ball bearings 200 being held by the bearing holding plate 190. As this resistance is overcome, the bearing holding plate 190 is lifted compressing the clutch spring 180. It is the tension of this clutch spring 180 (which has been adjusted by the T-handle 20 and input lock 40 feature) which determines the torque setting of the assembly. The features of which are further shown and described in later figures.

Figure 11:
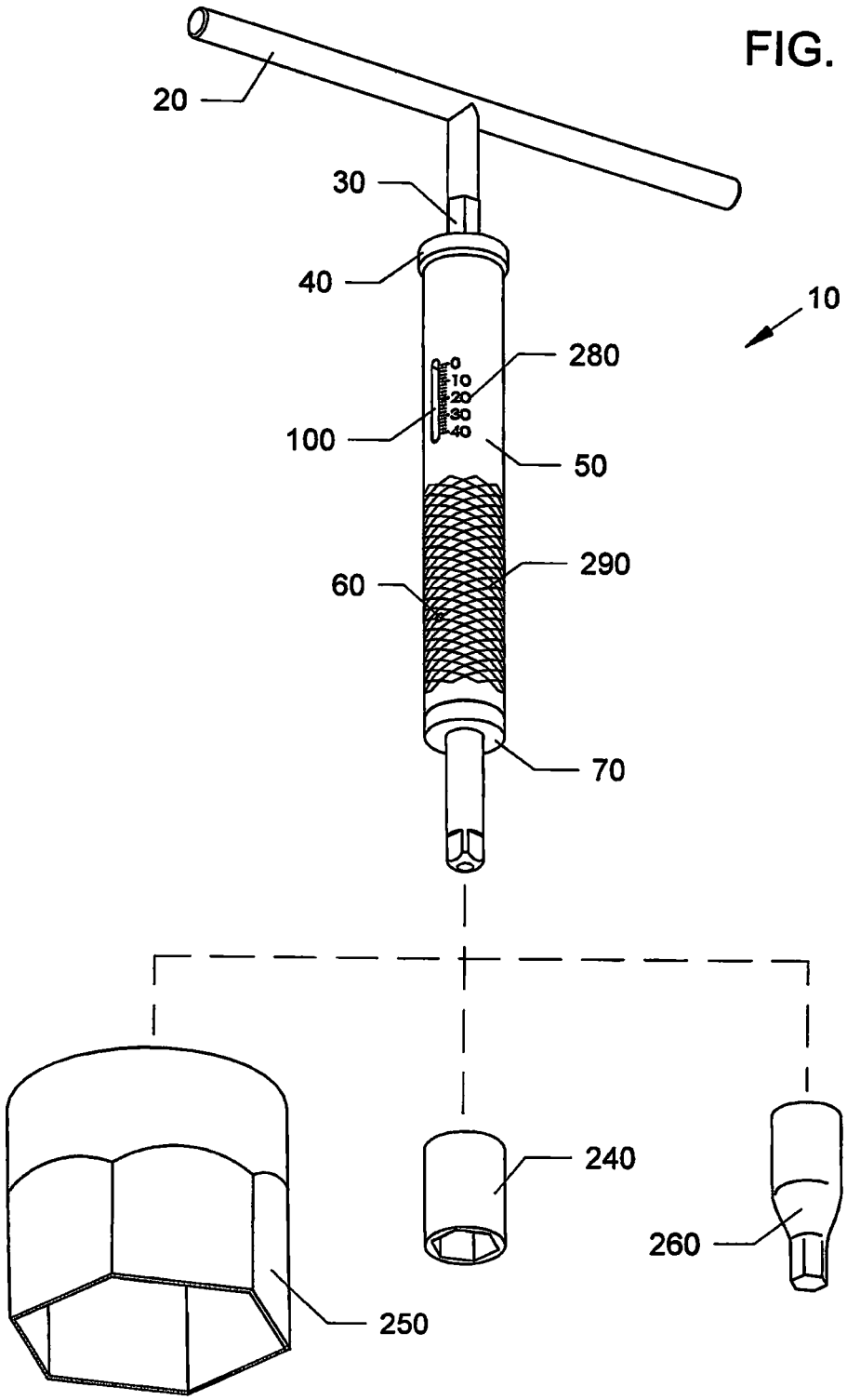
FIG. 11 is a bottom perspective view of the wrench of FIG. 1 with different drive accessories.
Figure 12:
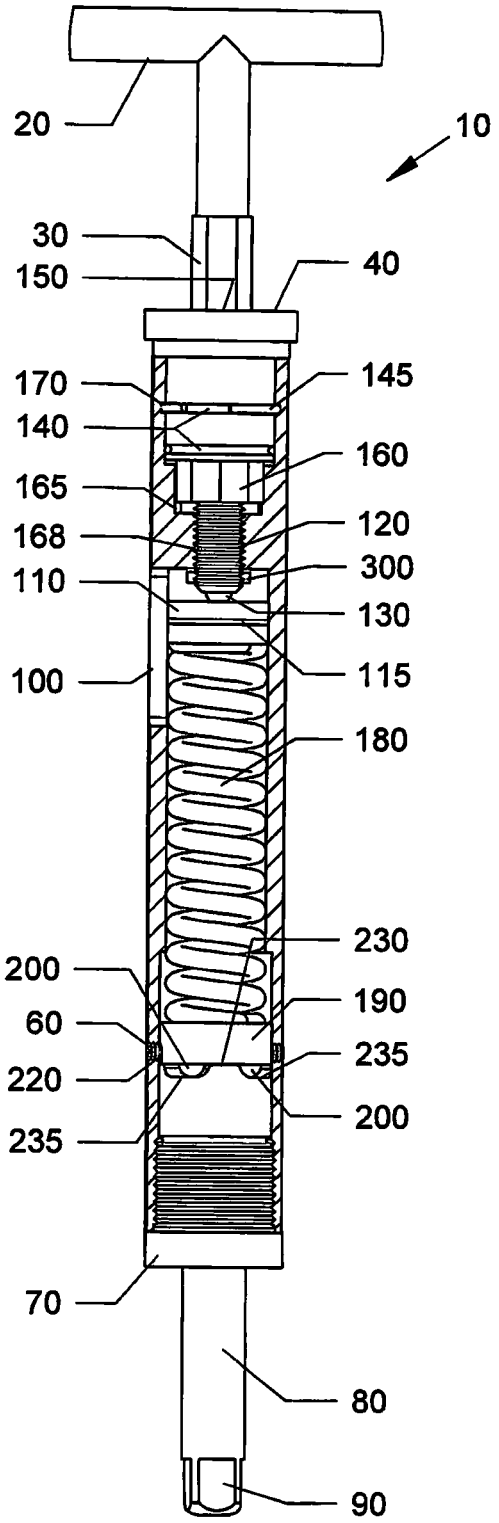
FIG. 12 is a cross-sectional view of the wrench of FIG. 1.
Figure 13:
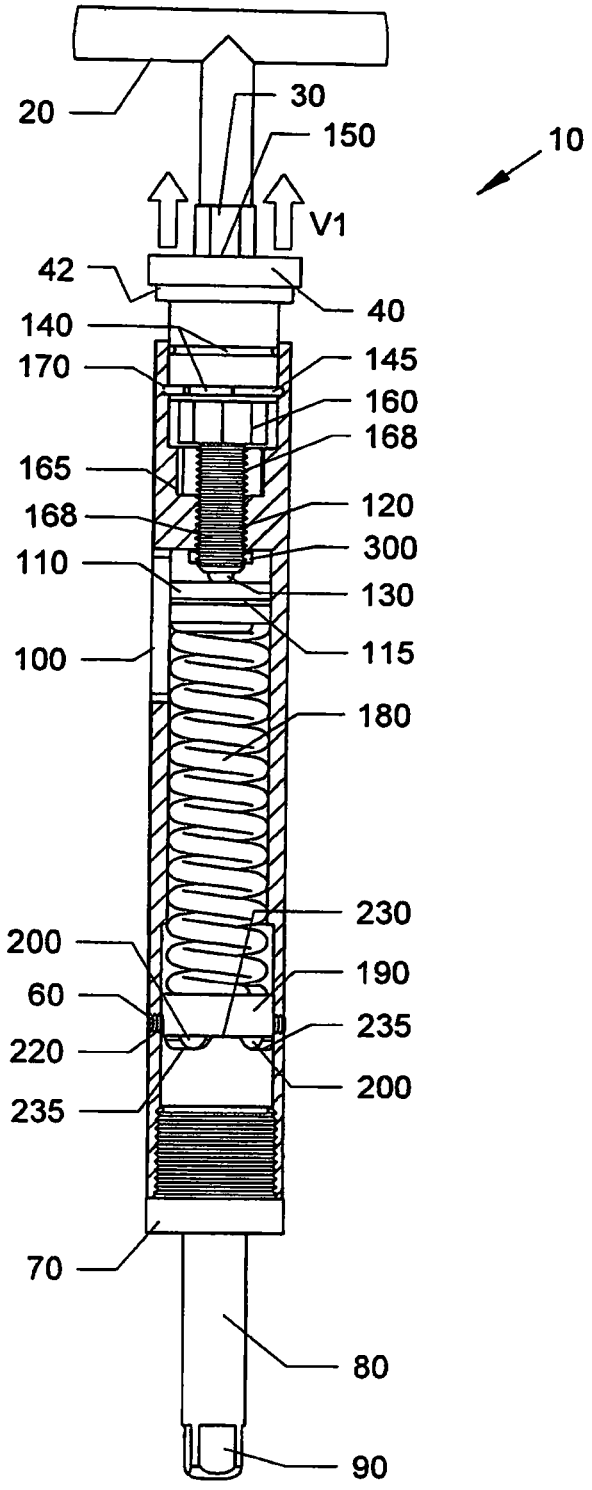
FIG. 13 is a cross-sectional view of the wrench of FIG. 12 with lock component pulled upward adjacent T handle.
Figure 14:
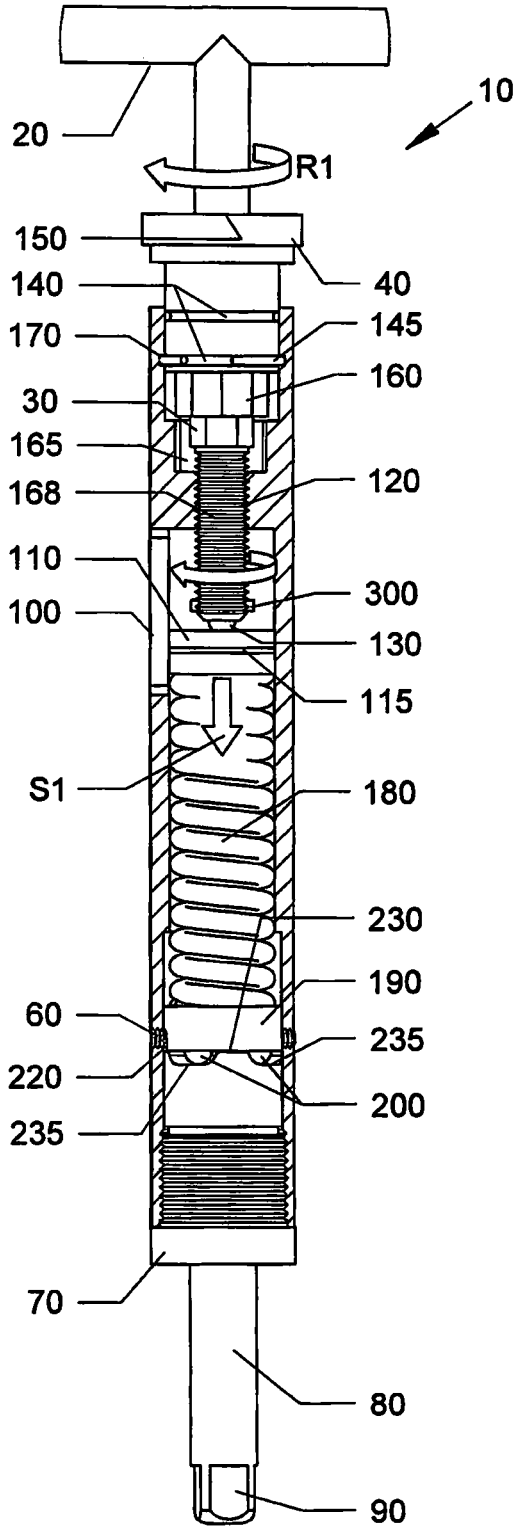
FIG. 14 is a cross-sectional view of the wrench of FIG. 13 with T handle rotated to a selected torque setting.
Figure 15:
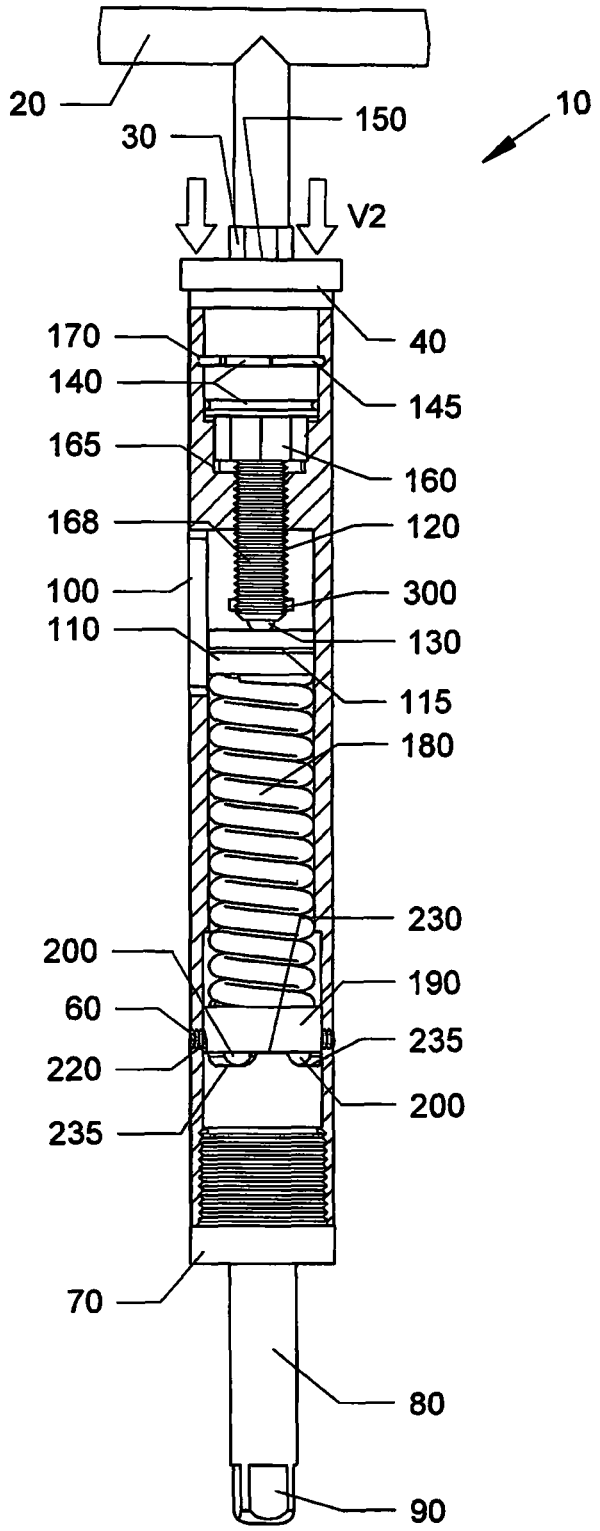
FIG. 15 is a cross-sectional view of the wrench of FIG. 14 with lock component pushed down to selected torque setting.

As shown in FIGS. 9A and 10A, a barrel end cap 70 can be used to cover the drive 90 so FIG. 11 is a bottom perspective view of the wrench 10 of FIG. 1 with different drive accessories, that can fit over the square drive 90. As shown in FIGS. 9A, 10A and 11, a square cavity from different drive accessories can be slipped over the drive 90. Such accessories can include but are not limited to a standard drive socket 240, an oil filter drive accessory 250, or hex drive accessory 260. Additionally a barrel end cap 70 can be used to cover the drive 90 so FIG. 12 is a cross-sectional view of the wrench 10 of FIG. 1. FIG. 13 is a cross-sectional view of the wrench 10 of FIG. 12 with input lock 40 pulled upward in the direction of arrow V1 by pulling on cap end 42 with overhanging edge so that the hollow center of hex form 150 on input lock 40 rises up about hex form 30 on adjacent T handle 20. FIG. 14 is a cross-sectional view of the wrench of FIG. 13 with T handle rotated clockwise in the direction of arrow R1 to a selected torque setting. FIG. 15 is a cross-sectional view of the wrench 10 of FIG. 14 with input lock 40 pushed down in the direction of arrow V2 to selected torque setting.

Adjusting the torque settings will be described in reference to FIGS. 5A, 5B and 12-15. The torque setting is initially changed by pulling up the input lock 40 in the direction of arrow V1, followed by turning the T-handle either clockwise in the direction of arrow R1 or counterclockwise in an opposite direction to increase or decrease compression on the clutch spring 180.

In FIG. 12 the input lock 40 is depressed which locks the torque adjustment. FIG. 13 is similar to FIG. 12 except the input lock 40 is pulled up as indicated by the motion arrows V1. This disengages the hex form 160 on the outside of the input lock 40 from the hex form 165 on the inside of the body 50 and thus allows the T-handle 20 to be rotated independent of the body 50 allowing the clutch spring 180 tension to be adjusted. It is the adjustment of the clutch spring 180 tension which changes the torque setting of the tool wrench 10.

FIG. 14 is similar to FIG. 13 except the T-handle 20 has been rotated in the direction of arrow R1. Rotation of the T-handle feeds the threaded portion 120 of the T-handle 20 down which, in turn, presses down by bearing 130 on the spacer plate 110 as indicated by the motion arrow S1. This increases the compression on the clutch spring 180 increasing the torque setting of the tool wrench 10. The input lock 40 remains pulled up so further adjustment is possible in this configuration.

Referring to FIGS. 5A, 5B and 14, the indicator line 115 on the spacer plate 110 is visible through the slot/window 100 so that the user can select and determine which torque setting such as but not limited to Foot Pounds or Newton Metres, and the like to be used.

FIG. 15 is similar to FIG. 14 except the input lock 40 has been depressed in the direction of arrow V2. This engages the hex form 160 on the outside of the input lock 40 with the hex form 165 on the inside of the body 50. Since the input lock 40 is always radially locked to the T-handle 40 via the hex forms 160, 165 on the outside of the T-handle 20 and the inside of the input lock 40 (with hex form 30), engaging the input lock 40 to the body 50 means that the body 50 must rotate when the T-handle 20 is rotated. So pushing down on the input lock 40 locks the adjustment made in clutch spring 180 tension made at FIG. 14. Tool wrench 10 torque has now increased from FIG. 12 and is ready to use.

Figure 16A:
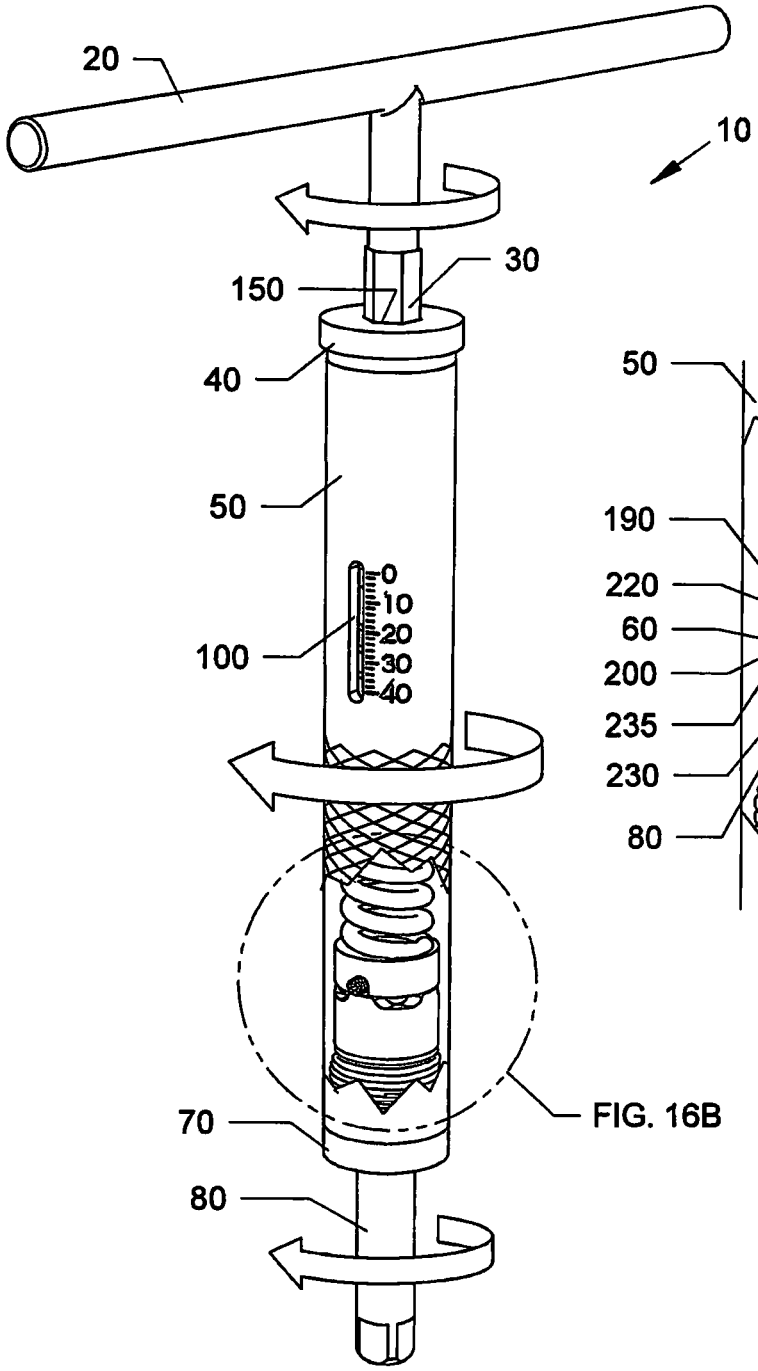
FIG. 16A is a perspective view of the torque wrench of FIG. 1 with clutch detail shown.
Figure 16B:
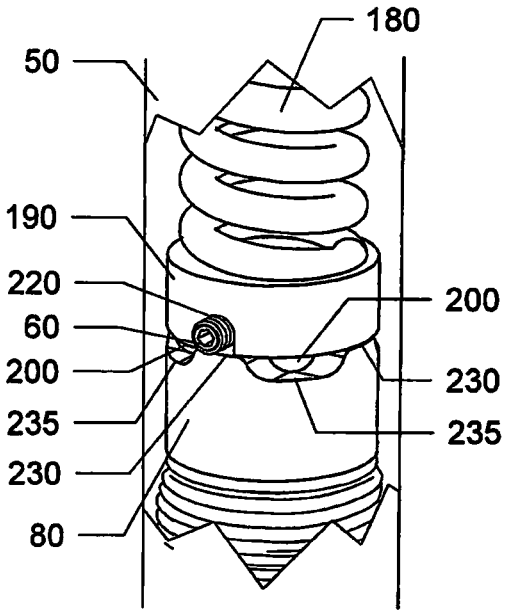
FIG. 16B is an enlarged view of clutch detail in FIG. 16A.

FIG. 16A is a perspective view of the torque wrench 10 of FIG. 1 with clutch detail 190-235 shown. FIG. 16B is an enlarged view of clutch detail 190-235 in FIG. 16A.

In FIGS. 16A-16B, the T-handle 20 is being rotated clockwise with the input lock 40 depressed. The T-handle 20 rotation in this configuration rotates the body 50 and the output shaft 80 as a unit. The output shaft 80 can have a drive accessory affixed in actual use (such as 240, 250, 260 shown FIG. 11). This view assumes no resistance on the output shaft 80 to rotation.

Figure 17A:
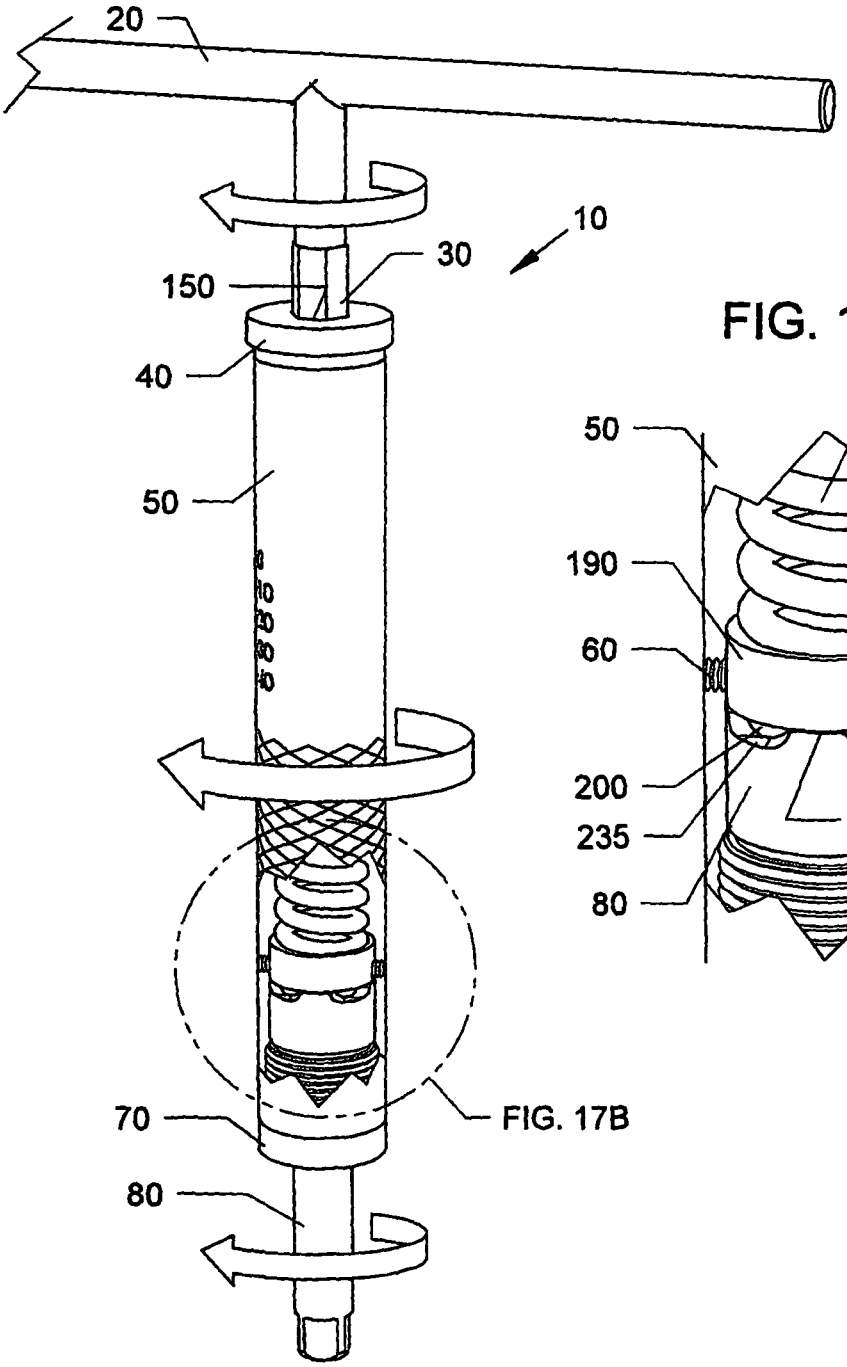
FIG. 17A is another perspective view of the wrench of FIG. 16A rotating slightly clockwise.
Figure 17B:
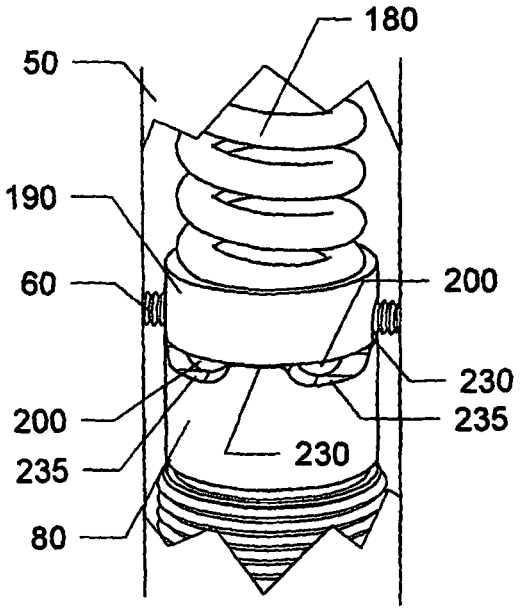
FIG. 17B is an enlarged view of the clutch of FIG. 17A.

FIG. 17A is another perspective view of the wrench 10 of FIG. 16A rotating slightly clockwise. FIG. 17B is an enlarged view of the clutch detail 190-235 of FIG. 17A. FIGS. 17A-17B is similar to FIGS. 16A-16B as FIG. 16 except the assembly has been rotated slightly counterclockwise (viewed from the bottom of the page) to expose more clutch detail 190-235. Plates 190 and 230 are continuing to both rotate in unison with one another, and the slip function is just staring to occur.

Figure 18A:
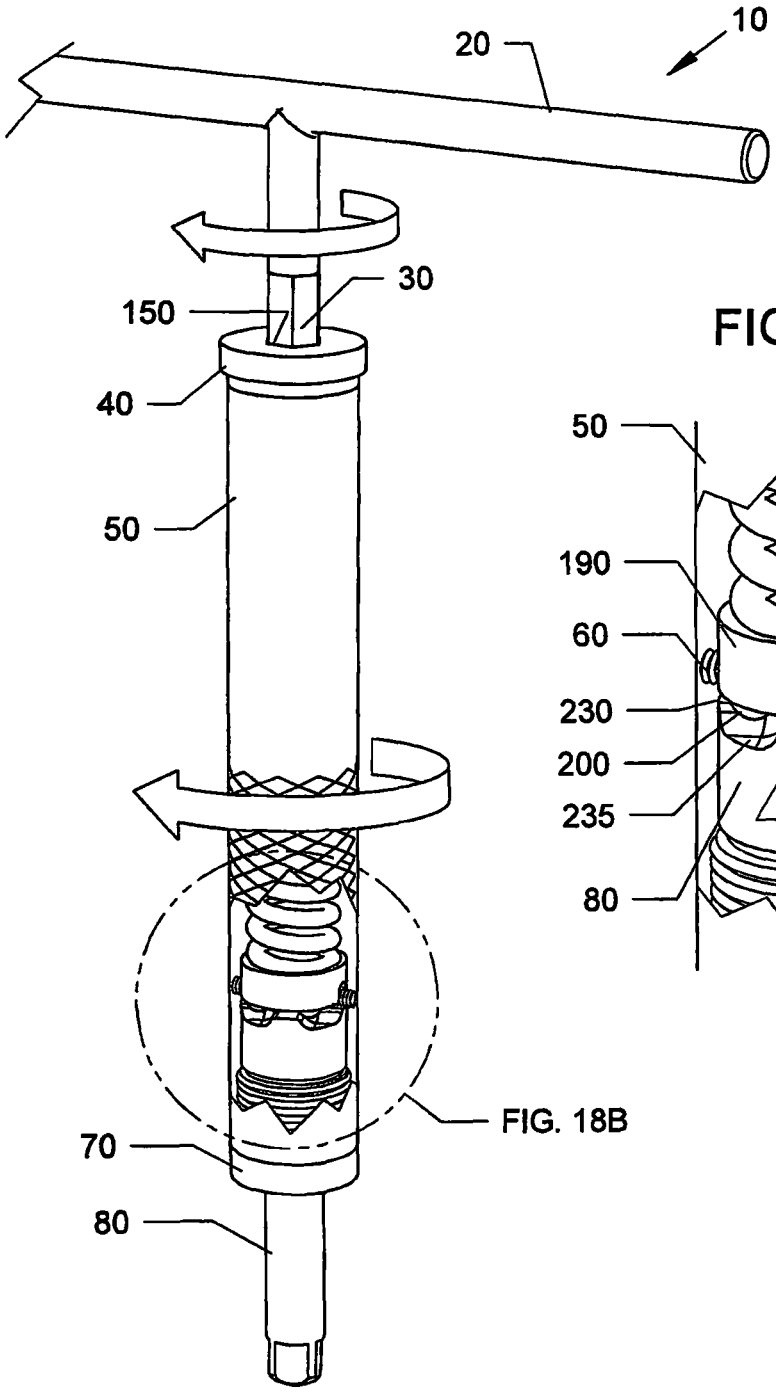
FIG. 18A is another perspective view of the turning wrench of FIG. 17A where the output shaft is no longer rotating.
Figure 18B:
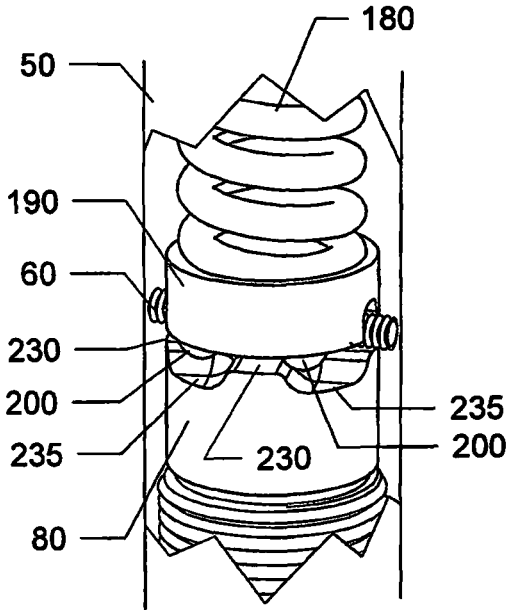
FIG. 18B is an enlarged view of the clutch detail of FIG. 18A.

FIG. 18A is another perspective view of the turning wrench 10 of FIG. 17A where the output shaft 80 is no longer rotating and the slip function is starting to go to a full slip mode. FIG. 18B is an enlarged view of the clutch detail 190-235 of FIG. 18A.

FIGS. 18A-18B are similar to FIGS. 17A-17B, except resistance to counterclockwise rotation (viewed from the bottom of the page) has been encountered by the output shaft 80 (such as when a bolt is being tightened and has reached a torque limit). The output shaft 80 is no longer turning with the body 50 and T-handle 20. In the clutch area 190-235, the ball bearings 200 have started riding up the inclines that form the sides of the bearing nests 235. This action wants to push the bearing holding plate 190 and the slip plate 230 apart. This separating action is resisted by the clutch spring 180 pushing down on plate 190. The strength of the resistance to separation is determined by the amount of spring 180 compression set as described and shown in FIGS. 12-14 above. If the resistance to this climb by the bearings 200 out of the bearing nests 235 is high, the slipping torque of the tool wrench 10 is high. If the resistance is low, the slipping torque is low.

Figure 19A:
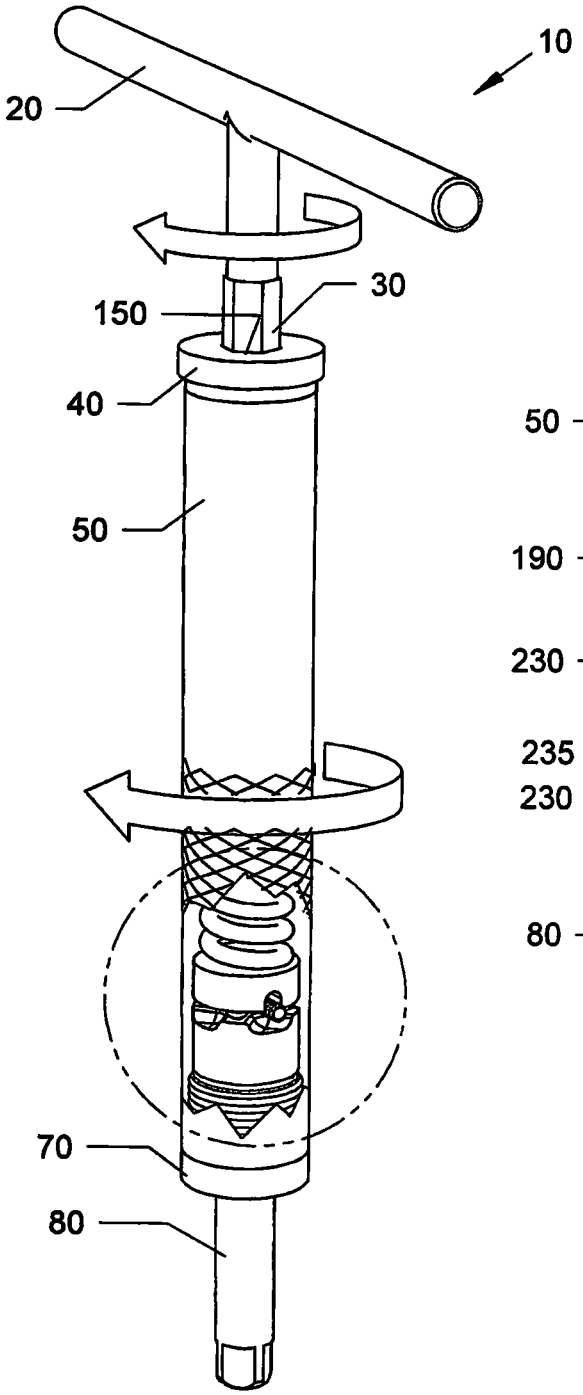
FIG. 19A is another perspective view of the rotating wrench of FIG. 18A with the bearings transitioning from their nests.
Figure 19B:
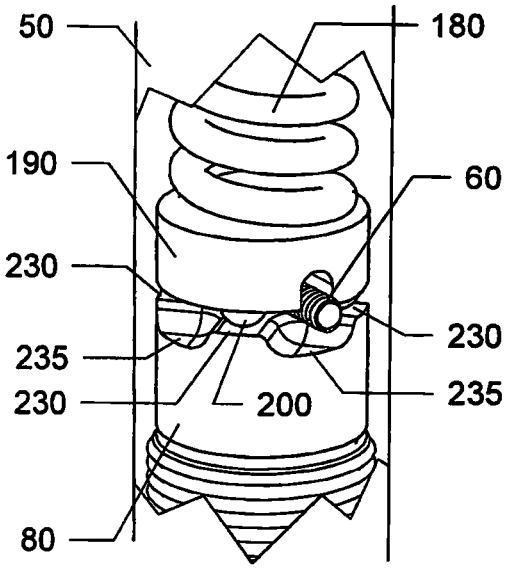
FIG. 19B is an enlarged view of the clutch detail of FIG. 19A.

FIG. 19A is another perspective view of the rotating wrench 10 of FIG. 18A with the bearings 200 transitioning from their nests 235 with the torque wrench 10 in a full slip function. FIG. 19B is an enlarged view of the clutch detail 190-235 of FIG. 19A.

FIGS. 19A-19B are similar to FIGS. 18A-18B except the bearings 200 have made the transition out of the bearing nests 235 and are now on top of the slip plate 230.

Figure 20A:
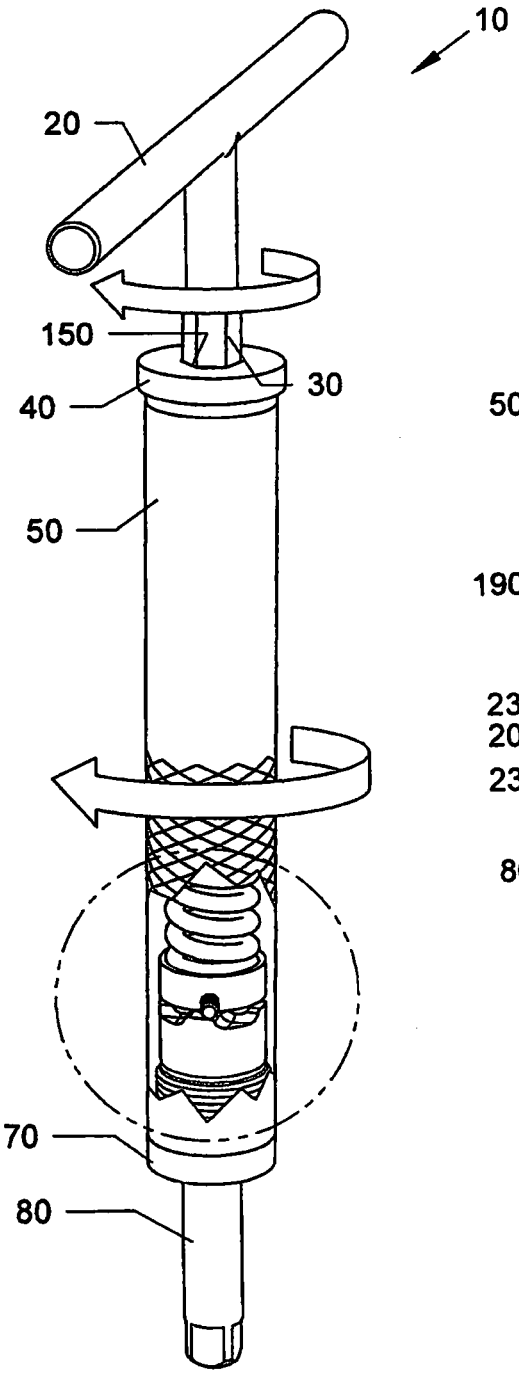
FIG. 20A is another perspective view of the rotating wrench of FIG. 19A where bearings have fallen off off top of slip plate.
Figure 20B:
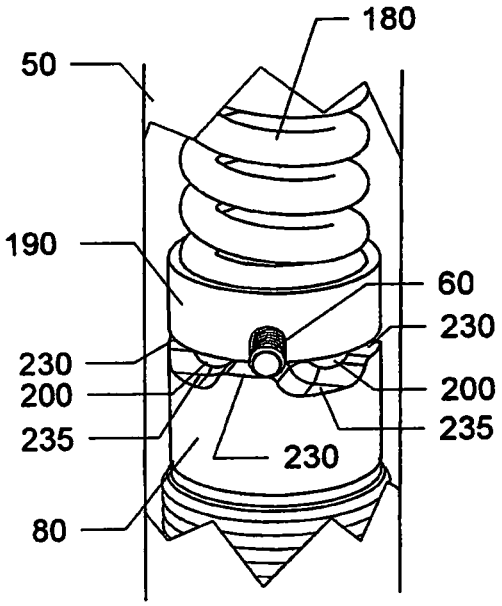
FIG. 20B is an enlarged view of the clutch detail of FIG. 20A.

FIG. 20A is another perspective view of the rotating wrench 10 of FIG. 19A where bearings 200 have fallen off of top of plate 230. FIG. 20B is an enlarged view of the clutch detail 190-235 of FIG. 20A.

FIGS. 20A-20B are similar to FIGS. 19A-19B, except the bearings 200 have fallen off of the top of the slip plate and are on their way down the nest side inclines back into the bearing nests 235.

Figure 21A:
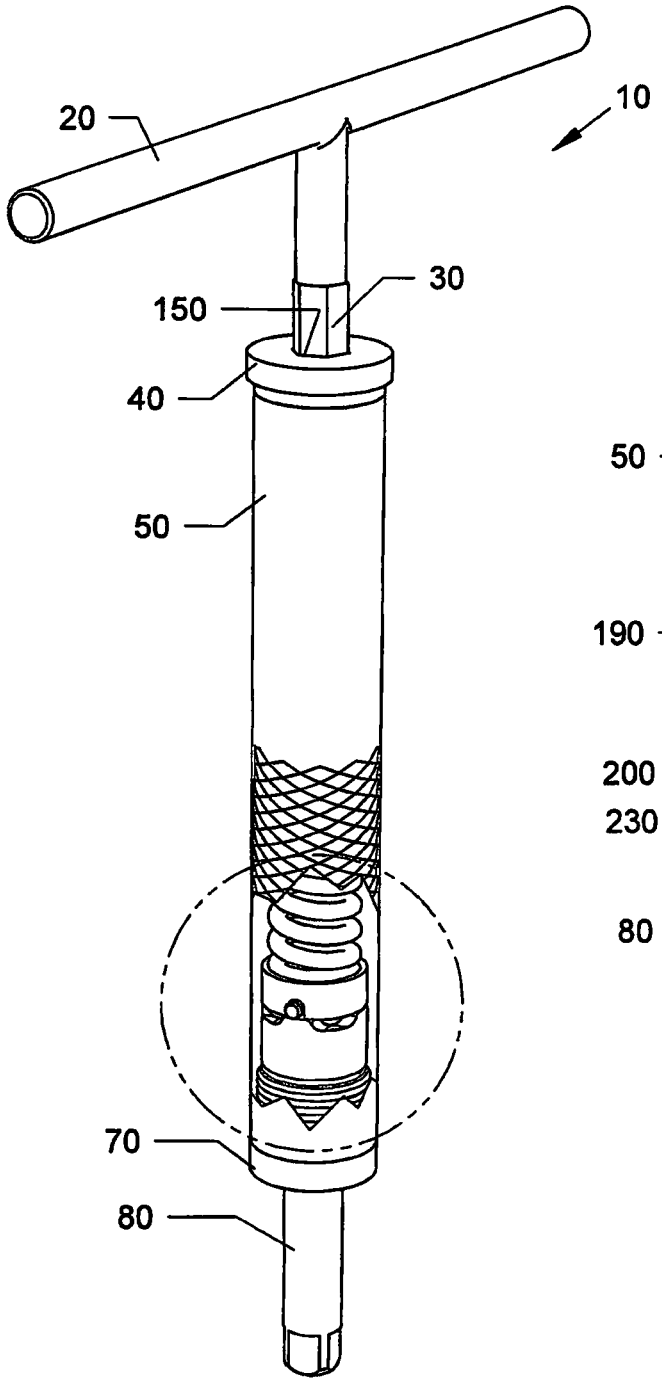
FIG. 21A is another perspective view of the rotating wrench of FIG. 20A where wrench is in full slip function.
Figure 21B:
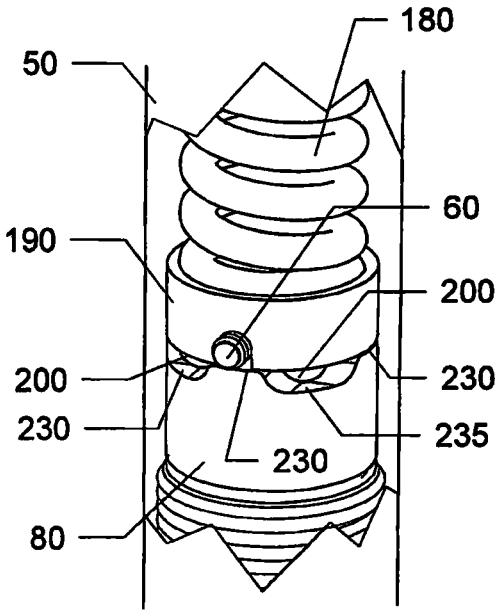
FIG. 21B is an enlarged view of the clutch detail of FIG. 21A.

FIG. 21A is another perspective view of the rotating wrench 10 of FIG. 20A where wrench 10 is in full slip function. FIG. 21B is an enlarged view of the clutch detail 190-235 of FIG. 21A.

FIGS. 21A-21B is similar to FIGS. 20A-2B. Here, the slip cycle is complete and the bearings 200 are all seated in the bearing nests 235 on the slip plate 230. This "slip cycle" shown and described in FIGS. 17A to 21B provides a tactile and audible feedback to the user that indicates that the target preset torque value setting has been reached. At this point the user would stop turning the T-handle 20 of the torque wrench 10.

Second Embodiment

FIG. 22 is an exploded view of a second embodiment wrench 400. FIG. 23 is a cross-sectional view of the assembled second embodiment wrench 400 of FIG. 22 showing detail of spacer plug 410 used instead of the spacer 110 of the previous embodiment, and upper and lower slip plates 492, 492 without the ball bearings 210 used in the previous embodiment.

FIG. 24 is an enlarged perspective view of the spacer plug 410 used in the wrench 400 of FIGS. 21-22. FIG. 25 is an enlarged view of the spacer plug 410 of FIG. 23 engaging with the spring 180 in the wrench 400 of FIG. 23.

FIG. 26 is an enlarged lower front exploded view of upper slip plate 492 on the bottom of the hollow spring cylinder support 490 and lower slip plate 482 on the top of the torque output shaft 480 of FIGS. 22-23. FIG. 27 is an enlarged upper front exploded view of the slip plate 492 on the bottom of the hollow spring cylinder support 490 and slip plate 482 on the top of the torque output shaft 480 of FIG. 26.

FIG. 28 is a perspective view of the wrench 400 of FIGS. 22-23 with a partial cutaway showing the slip plates 492, 482 in a slip position. FIG. 28A is an enlarged view of the partial cutaway portion of the slip plates 492, 482 of FIG. 28.

FIG. 29 is another perspective view of the wrench 400 of FIG. 27 with a partial cutaway showing the slip plates 482, 492 in a lock position. FIG. 29A is an enlarged view of the partial cutaway portion of the slip plates 492, 482 of FIG. 28.

Referring to FIGS. 22-29A, the torque wrench 400 can function similar to the torque wrench 10 in the previous embodiment, with two major changes. The spacer plug 410 has been substituted for the spacer 10 used in the previous torque wrench 10. And a hollow spring cylinder support 490 with slip plate 492 and torque output shaft 480 with upper slip plate 482 is now being used without the ball bearings 210 and different slip plates 190, 230, 235 used in the previous embodiment.

Referring to FIGS. 22-25, the spacer plug 410 includes an enlarged base 412 with a threaded indentation 415 on top, and a downwardly extending narrow diameter stem 420. The bottom of the torque adjustment thread 120 on the T-handle 20 can thread through the input lock 40 as described in the previous embodiment with the end of the thread 120 passing into and threading into the threaded indentation 415 in the top of the base 412 of the spacer plug 410. The stem 420 inserts into and through the top portion of the spring 180. Working similar to the spacer 110 the marker indicator line 418 can be viewed through the torque set indicator slot/window 100 and adjusted by viewing the torque adjustment graduated scale 280 as described in the previous embodiment.

A benefit of the spacer plug 410 is to hold the spring in line and in place, which helps keep the spring from binding and not jamming inside. The spacer plug 410 helps guide the spring when it is being compressed, and helps secure the spring inside.

Referring to FIGS. 22-23 and 28-29A, the bottom of spring 180 is supported inside the hollow spring cylinder support 490. The bottom of the cylinder support 490 can have a slip plate 492 having a plurality of raised cam lobes (flat topped humps with outwardly sloping sides) 494 with grooves 496 therebetween.

A torque output shaft 480 can have a drive end 90, which is shown and described in the previous embodiment. The top of shaft 480 can have a slip plate 482 that includes a plurality of raised cam lobes (flat topped humps with outwardly sloping sides) 482 with grooves 486 therebetween. The flat topped humps 494 of the top slip plate 492 can be mateable to the grooves 486 in the bottom slip plate 482. Similarly, the flat topped humps 484 in the bottom slip plate 482 can be mateable to the grooves 496 in the top slip plate 492. Rotating of the T-handle 20 can be done similar to the previous embodiment where the slip plates 492, 482 can pass from slip positions to a lock position as previously described.

Referring to FIGS. 22, 29 and 29A, hollow spring cylinder support 490 can move up while pin 60 can slide within vertical slot 491 similar to set pin 60 which allows plate 190 to move upward in vertical slot 220, similar to pin 60 in slot 220 shown and described relative to FIGS. 10A-10B, 19A, 19B.

While the slip plates shows four humps in each of the first and second slip plates, the number of humps can be less than or more than four humps as needed.

Preferably, the humps in the first slip plate can be identical to the humps in the second slip plate. Similarly, the grooves in the first slip plate can be identical to the grooves in the second slip plate.

With this embodiment, there is no need for ball bearings 210 that are used in the previous embodiment. Eliminating the ball bearings can reduce the costs, and reduces the chances of any of the ball bearings from jamming and/or falling out over time.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A torque wrench, consisting of:

a handle having a stem portion;

an elongated cylindrical shaft having an upper end and a lower end with a longitudinal axis there between;

an output shaft having a longitudinal axis extending beneath the lower end of the elongated cylindrical shaft, with the longitudinal axis of the elongated cylindrical shaft and the longitudinal axis of the output shaft in a vertical orientation with one another, the lower end of the output shaft having a driver head;

an adjustable lock assembly between the stem portion of the handle and the upper end of the elongated cylindrical shaft, the adjustable lock assembly for adjusting the torque wrench to selected torque settings, the adjustable lock assembly having a threaded member which extends downward from the stem portion and is threadably moveable into a threaded neck inside an upper portion of the elongated cylindrical shaft, the adjustable lock assembly has a lock component with an extended raised position for allowing a bottom portion of the downward extended threaded member to be rotatable by the handle to each of the selected torque settings by being rotated into the threaded neck, and the lock component having a down position which locks the handle to one of the selected torque settings;

a slip assembly in the elongated cylindrical shaft, the slip assembly having an elongated spring with a first end underneath the bottom portion of the threaded member and a second end on top of a first slip plate, the elongated spring having a longitudinal axis in a vertical orientation along the longitudinal axis of the elongated cylindrical shaft, the first slip plate having a top side for receiving the second end of the elongated spring and a bottom side with a plurality of first raised humps and a plurality of first grooves therebetween, each of the first plurality of raised humps include a flat top and flat sides which slope outwardly from the top to the grooves, and a convex curved front face having a front width, and a concave curved rear face having a rear width shorter, than the front width, and each of the first grooved having a flat upper surface;

a second slip plate on top of the output shaft having a top side with a plurality of second raised humps and a plurality of second grooves therebetween;

each of the second plurality of raised humps include a flat top and flat sides which slope outwardly from the top to the grooves, and a convex curved front face having a front width, and a concave curved rear face having a rear width shorter, than the front width, and each of the second grooves having a flat upper surface, wherein rotating the handle causes the plurality of raised humps in the first slip plate to pass into and out of the plurality of second grooves in the second slip plate while the plurality of humps in the second slip plate passes into and out of the plurality of first grooves in the first slip plate, wherein rotating the handle beyond the selected torque setting cause the first plate to continue to rotate when the output shaft stops rotating when the selected torque setting is reached, the first and second slip plates causing the torque wrench to pass into a slip function when a selected torque setting has been reached, wherein the plurality of the first humps and the plurality of the second humps include flat topped humps with outwardly sloped sides, wherein the plurality of the first humps and the plurality of the second humps each include an identical number of humps, and the plurality of the first grooves and the plurality of the second grooves each include an identical number of grooves, wherein the top side of the first slip plate includes:

a hollow cylinder for receiving the second end of the elongated spring therein, and a set pin for passing through a vertically oriented slot in a side of the hollow cylinder for holding the second end of the spring inside of the hollow cylinder, wherein the hollow cylinder is moveable upward while the set pin slides within the vertical slot;

a spacer plug between the bottom of the threaded member and the first end of the elongated spring, wherein the spacer plug includes a disc shaped base with a narrower diameter stem extending below the base, the base having an upper side for receiving a lower end of the threaded member, wherein the upper side of the base includes a threaded indentation for threadably receiving the lower end of the threaded member therein, wherein the narrower diameter stem fits into and through a top of the elongated spring, and wherein the handle includes a T shaped handle.

2. A torque wrench, consisting of:

a handle having a stem portion;

an elongated cylindrical shaft having an upper end and a lower end with a longitudinal axis there between;

an output shaft having a longitudinal axis extending beneath the lower end of the elongated cylindrical shaft, with the longitudinal axis of the elongated cylindrical shaft and the longitudinal axis of the output shaft in a vertical orientation with another, the lower end of the output shaft having a driver head;

an adjustable lock assembly between the stem portion of the handle and the upper end of the elongated cylindrical shaft, the adjustable lock assembly for adjusting the torque wrench to selected torque settings, the adjustable lock assembly having a threaded member which extends downward from the stem portion and is threadably moveable into a threaded neck inside an upper portion of the elongated cylindrical shaft, the adjustable lock assembly has a lock component with an extended raised position for allowing a bottom portion of the downward extended threaded member to be rotatable by the handle to each of the selected torque settings by being rotated into the threaded neck, and the lock component having a down position which locks the handle to one of the selected torque settings; and a slip assembly in the elongated cylindrical shaft, the slip assembly having an elongated spring with a first end underneath the bottom portion of the threaded member and a second end on top of a first slip plate, the elongated spring having a longitudinal axis in a vertical orientation along the longitudinal axis of the elongated cylindrical shaft the first slip plate having a top side for receiving the second end of the elongated spring and a bottom side having a first plurality of raised humps and first grooves, each of the first plurality of raised humps include a flat top and flat sides which slope outwardly from the top to the grooves, and a convex curved front face having a front width, and a concave curved rear face having a rear width shorter, than the front width, and each of the first grooves having a flat upper surface;

a second slip plate on top of the output shaft having a top side for being rotatably sandwiched with the bottom side of the first slip plate without using ball bearings therebetween, the top side having a second plurality of humps and second grooves therebetween, each of the second plurality of raised humps include a flat top and flat sides which slope outwardly from the top to the grooves, and a convex curved front face having a front width, and a concave curved rear face having a rear width shorter, than the front width, and each of the second grooves having a flat upper surface, wherein rotating the handle beyond the selected torque setting cause the first plate to continue to rotate when the output shaft stops rotating when the selected torque setting is reached, the first and second slip plates causing the torque wrench to pass into a slip function when a selected torque setting has been reached;

a spacer plug between the bottom of the threaded member and the first end of the elongated spring, the space plug includes a disc shaped base with a narrower diameter stem extending below the base, the base having an upper side for receiving a lower end of the threaded member, wherein the upper side of the base includes a threaded indentation for threadably receiving the lower end of the threaded member therein, wherein the narrower diameter stem fits into and through a top of the elongated spring, wherein the handle includes a T shaped handle, wherein the adjustable lock assembly includes a window on the elongated cylindrical shaft having an indicator line moveable between each of the selected torque settings, wherein the adjustable lock assembly includes a horizontal scale and a vertical line adjacent to the upper end of the elongated cylindrical shaft, so that adjusting the torque wrench to selected torque settings moves the vertical line to a selected torque setting on the scale, wherein the output shaft includes an accessory for being attachable and detachable to the driver head, the accessory being selected from at least one of a drive socket, an oil filter drive accessory and a hex drive accessory.

* * * * *